US009318115B2

(12) United States Patent
Vasilache et al.

(10) Patent No.: US 9,318,115 B2
(45) Date of Patent: Apr. 19, 2016

(54) EFFICIENT CODING OF BINARY STRINGS FOR LOW BIT RATE ENTROPY AUDIO CODING

(75) Inventors: Adriana Vasilache, Tampere (FI); Lasse Juhani Laaksonen, Nokia (FI); Anssi Sakari Rämö, Tampere (FI); Mikko Tapio Tammi, Tampere (FI)

(73) Assignee: Nokia Technologies Oy, Espoo (FI)

( * ) Notice: Subject to any disclaimer, the term of this patent is extended or adjusted under 35 U.S.C. 154(b) by 243 days.

(21) Appl. No.: 13/988,887

(22) PCT Filed: Nov. 26, 2010

(86) PCT No.: PCT/IB2010/055451

§ 371 (c)(1),
(2), (4) Date: May 22, 2013

(87) PCT Pub. No.: WO2012/069886

PCT Pub. Date: May 31, 2012

(65) Prior Publication Data

US 2013/0246076 A1 Sep. 19, 2013

(51) Int. Cl.
*G10L 19/00* (2013.01)
*G10L 19/032* (2013.01)

(52) U.S. Cl.
CPC ..... *G10L 19/0019* (2013.01); *G10L 19/032* (2013.01)

(58) Field of Classification Search
None
See application file for complete search history.

(56) References Cited

U.S. PATENT DOCUMENTS

| | | | | |
|---|---|---|---|---|
| 2001/0014127 | A1 | 8/2001 | Nagai et al. | |
| 2006/0074693 | A1* | 4/2006 | Yamashita | 704/500 |
| 2007/0146173 | A1 | 6/2007 | Sakaguchi | |
| 2007/0168197 | A1* | 7/2007 | Vasilache | 704/503 |
| 2008/0228476 | A1* | 9/2008 | Mehrotra et al. | 704/230 |
| 2009/0238474 | A1 | 9/2009 | Sandberg | |
| 2010/0023336 | A1* | 1/2010 | Shmunk | 704/503 |

FOREIGN PATENT DOCUMENTS

| | | |
|---|---|---|
| WO | WO 2007/046027 A1 | 4/2007 |
| WO | 2009100768 | 8/2009 |

OTHER PUBLICATIONS

Written Opinion for International Application No. PCT/IB2010/055451, dated Aug. 29, 2011, 7 pages.

(Continued)

*Primary Examiner* — Qian Yang
(74) *Attorney, Agent, or Firm* — Alston & Bird LLP

(57) ABSTRACT

It is inter alia disclosed to apply a function on a string in accordance with a rule of a set of rules, the string comprising first and second representatives, wherein the function ensures that the string comprises at least one of a predetermined representative at an end of the string after the function has been applied; and to determine a representation of the string, wherein said representation comprises at least one encoded representative, each of said at least one encoded representative being associated with at least one representative of the string, wherein said representation does not comprise an encoded representative being associated with at least one of the at least one predetermined representative at the end of the string.

18 Claims, 11 Drawing Sheets

(56) References Cited

OTHER PUBLICATIONS

Vasilache, A. et al., *Multiple-scale leader-lattice VQ with application to LSF quantization*, Signal Processing, vol. 82 (2002) 563-586.

International Search Report received for corresponding Patent Cooperation Treaty Application No. PCT/IB2010/055451, dated Aug. 29, 2011, 5 pages.

* cited by examiner

EFFICIENT CODING OF BINARY STRINGS FOR LOW BIT RATE ENTROPY AUDIO CODING

RELATED APPLICATION

This application was originally filed as PCT Application No. PCT/IB2010/055451 filed Nov. 26, 2010.

FIELD

Embodiments of this invention relate to coding, in particular to speech and audio coding.

BACKGROUND

Low complexity algorithms for speech and audio coding constitute a very relevant asset, for instance for mobile terminal based communications. Due to low storage and low complexity, while preserving coding efficiency, structured codebooks may be preferred in several state of the art speech and audio codecs, like for instance the Enhanced Voice Service (EVS) codec to be standardized within the Third Generation Partnership Project (3GPP).

Most of today's state of the art speech and audio codecs incorporate transform coding into their structure. The transform coefficients form a long vector (hundreds of samples, depending on the sampling frequency) that is encoded with a given bitrate for each frame. The encoding is done by splitting the long vector in subvectors that can be encoded using a variable rate per subvector approach. For low bitrates it is more efficient to select the subvectors that are represented by non null codevectors and to encode separately the position of such vectors.

SUMMARY OF SOME EMBODIMENTS OF THE INVENTION

Although the use of encoding by selecting the subvectors that are represented by non null codevectors and to encode separately the position of such vectors reduces the amount of memory and the computational complexity required for encoding an input vector, further reduction of the memory requirements and/or the computational complexity is desirable, for instance with respect to encoding a string comprising information on the position of non null codevectors.

According to a first aspect of the present invention, a method is disclosed, said method comprising applying a function on a string in accordance with a rule of a set of rules, the string comprising first and second representatives, wherein the function ensures that the string comprises at least one of a predetermined representative at an end of the string after the function has been applied, determining a representation of the string, wherein said representation comprises at least one encoded representative, each of said at least one encoded representative being associated with at least one representative of the string, wherein said representation does not comprise an encoded representative being associated with at least one of the at least one predetermined representative at the end of the string.

According to a second aspect of the present invention, an apparatus is disclosed, which is configured to perform the method according to the first aspect of the present invention, or which comprises means for performing the method according to the first aspect of the present invention, i.e, means for applying a function on a string in accordance with a rule of a set of rules, the string comprising first and second representatives, wherein the function ensures that the string comprises at least one of a predetermined representative at an end of the string after the function has been applied, means for providing a representation of the string, wherein said representation comprises at least one encoded representative, each of said at least one encoded representative being associated with at least one representative of the string, wherein said representation does not comprise an encoded representative being associated with at least one of the at least one predetermined representative at the end of the string.

According to a third aspect of the present invention, an apparatus is disclosed, comprising at least one processor; and at least one memory including computer program code, said at least one memory and said computer program code configured to, with said at least one processor, cause said apparatus at least to perform applying a function on a string in accordance with a rule of a set of rules, the string comprising first and second representatives, wherein the function ensures that the string comprises at least one of a predetermined representative at an end of the string after the function has been applied; providing a representation of the string, wherein said representation comprises at least one encoded representative, each of said at least one encoded representative being associated with at least one representative of the string, wherein said representation does not comprise an encoded representative being associated with at least one of the at least one predetermined representative at the end of the string.

According to a fourth aspect of the present invention, a computer program is disclosed, comprising program code for performing the method according to the first aspect of the present invention when the computer program is executed on a processor. The computer program may for instance be distributable via a network, such as for instance the Internet. The computer program may for instance be storable or encodable in a computer-readable medium. The computer program may for instance at least partially represent software and/or firmware of the processor.

According to a fifth aspect of the present invention, a computer-readable medium is disclosed, having a computer program according to the fourth aspect of the present invention stored thereon. The computer-readable medium may for instance be embodied as an electric, magnetic, electro-magnetic, optic or other storage medium, and may either be a removable medium or a medium that is fixedly installed in an apparatus or device. Non-limiting examples of such a computer-readable medium are a RAM or ROM. The computer-readable medium may for instance be a tangible medium, for instance a tangible storage medium. A computer-readable medium is understood to be readable by a computer, such as for instance a processor.

The input string may comprise a sequence of at least one symbol, wherein each of the at least one symbol may be taken from an alphabet comprising a first representative and a second representative. The term string may also be understood as a vector which comprises the sequence of at least one symbol. The length of the string may be limited, i.e. the string may comprise a predefined number symbols. To name an example, this alphabet may represent a binary alphabet, wherein the first representative may represent a '0' and the second representative may represent a '1' or vice versa. With respect to this example, the string may be considered to represent a binary string. As a non-limiting example, this binary alphabet may be used for a string comprising information of the position of null and non-null subvectors used for encoding.

A function may be applied on the string in accordance with a rule of a set of rules, wherein the function ensures that the string comprises at least one predetermined representative at the end of the string after the function has been applied. For instance, the predetermined representative may be the first representative or the second representative, wherein the rule of the set of rules may define the predetermined representative. The function ensures that the string comprises at least one predetermined representative at the end of the string, i.e., there is one predetermined representative at the end of the string or at least two predetermined representatives at the end of the string, wherein the at least two predetermined representatives are at least two neighbouring representatives of the predetermined representative. Thus, the at least one predetermined representative at the end of the string is represented by a succession of at least one of the predetermined representative at the end of this string.

For instance, the end of the string may represent the right end of the string or the left end of the string, wherein the right end of the string may be represented by the last representatives in the string and the left end of the string may be represented by the first representatives in the string (or vice versa). Furthermore, for instance, the end of the string may be a predefined position in the string.

For instance, the function, which ensures that there is at least one predetermined representative at an end of the string, may comprise checking if there is at least one of the predetermined representative at the end of the string. Thus, for instance, in case there is at least one of the predetermined representative at the end of the string, it is ensured that there is at least one predetermined representative at the end of string. Furthermore, the function may comprise permutating at least one representative in the string in a manner that after this permutation there is at least one predetermined representative at the end of the string. This permutation may be performed in accordance with the rule of the set of rules, i.e., a rule of the set of rules may be associated with a respective permutation.

Then, a representation of the string is determined, wherein said representation comprises at least one encoded representative, each of said at least one encoded representative being associated with at least one representative in the string, wherein said representation does not comprises an encoded representative being associated with at least one of the at least one predetermined representative at the end of the string.

Accordingly, the representation of the string may comprise at least one encoded representative, wherein each of this at least one encoded representative is associated with one or more representatives of the string, but none of this at least one encoded representative is associated with at least one of the at least one predetermined representative at the end of the string. Nevertheless, a reconstruction of the string may for instance be possible by means of decoding the encoded representatives of the representation, thereby generating the representatives of the string except for the at least one of the at least one predetermined representative at the end of the string, and filling the remaining positions at the end of the string with the predetermined representative in accordance with the rule. For instance, it may be assumed that the length of the string is known. As an example, said at least one of the at least one predetermined representative at the end of the string may be all of the at least one predetermined representative at the end of the string.

Said determining a representation of a string may comprise an encoding for determining at least one encoded representative, but said determining may also be understood that said at least one encoded representative has already been encoded and is selected for providing the representation of the string. For instance, an encoding be performed based on all representatives in the string in order to determine a set of encoded representatives, wherein for determining the representation of the string only those encoded representatives are selected from the set of encoded representatives which are not associated with at least one of the at least one predetermined representative at the end of the string.

The encoding may be performed by means of any well-suited encoding. For instance and as non-limiting example, this encoding may be based on a run-length encoding or on another encoding scheme.

According to an exemplary embodiment of all aspects of the present invention, said predetermined representative is one of the first and second representative and wherein a complementary representative is the other of the first and second representative, and where said function comprises classifying the string into at least two groups of representatives, each of said at least two groups comprising no or at least one representative of the string, wherein a last group of the at least two groups is associated with at least one complementary representative at the end of the string, if possible, and permutating at least the last group to another position in the string.

Thus, the last group may be associated with all of the complementary representatives at the end of the string. If there are no complementary representatives at the end of the group, then this last group may be represented as empty group. Accordingly, due to the permutation of the last group comprising all the complementary representatives at the end of the string to another position in the string, i.e., to the beginning of the string or between two other groups of the string, it is ensured that the permutated string comprises at least one of the predetermined representative at the end of the string.

Furthermore, for instance, a first group may be associated with at least one or with all of the complementary representatives at the beginning of the string, and, one or more groups may be associated with the representatives of the string between the first group and the last group. Then, the last group is permutated to the beginning of the string or to a position between the first group and one of the one or more groups. For instance, the last group may be permutated to a position between the first group and the subsequent group.

As a non-limiting example, the predetermined representative may be representative '0' and the complementary representative may be representative '1' (another assignment may also possible). For instance, as a non-limiting example, the original string may be represented by S1=[1 1 1 1 1 1 1 0 0 0 1 1 0 0 0 0 1 0 0 0 0 0 0 0 1 1 1 1].

Thus, for instance, the last group may be associated with the last four complementary representatives '1' at the end of the string, i.e., G1 may be considered as last group, wherein G1=[1 1 1 1] holds. Furthermore, for instance, the first group may be associated with the six complementary representatives '1' at the beginning of the string, i.e., G1 may be considered as first group, wherein G1=[1 1 1 1 1 1] holds. The representatives in the original string between the first and last group may be associated with one or more groups. For instance, a second group G2 may comprise the representatives between the first group G1 and the last group G1, i.e., G2=[0 0 0 1 1 0 0 0 0 1 0 0 0 0 0 0 0] may hold.

The last group G1 of the original string is permutated to another position in the string. For instance, as exemplarily mentioned above, the last group may be permutated between the first group G1 and the subsequent group G2. Thus, the permutated string may be represented by S1-a=[G1 G1 G2].

As another non-limiting example, the original string may be represented by S2=[1 1 1 1 1 1 1 0 0 0 1 1 0 0 0 0 1 0 0 0 0 0 0 1 1 1 1 0 0].

Thus, for instance, the last group may be associated with no representative since there are two of the predefined representatives at the end of the string, but no one of the complementary representative of at the end of the string. I.e, G1 may be considered as last group, wherein G1=[ ] holds.

Furthermore, for instance, the first group may be associated with the six complementary representatives '1' at the beginning of the string as mentioned, i.e., G1 may be considered as first group, wherein G1=[1 1 1 1 1 1] holds. The representatives in the original string between the first and last group may be associated with one or more groups. For instance, a second group G2 may comprise the representatives between the first group G1 and the last group G1, i.e., G2=[0 0 0 1 1 0 0 0 0 1 0 0 0 0 0 0 0 1 1 1 1 0 0] may hold.

The last group G1 of the original string is permutated to another position in the string. For instance, as exemplarily mentioned above, the last group may be permutated between the first group G1 and the subsequent group G2. Thus, the permutated string may be represented by S2-a=[G1 G1 G2]. Furthermore, the one or more groups in the original string between the first group and the last group may be classified in a way, that each of this one or more group comprises either only first representatives or second representatives.

For instance, with respect to exemplary original string S1, this one or more groups may be represented by groups G2', G3', G4', G5', G6', wherein G2' comprises the neighbouring predetermined representatives '0' subsequent to group G1, i.e., G2'=[0 0 0] holds, wherein G3' comprises the neighbouring complementary representatives '1' subsequent to group G2', i.e., G3'=[1 1] holds, wherein G4' comprises the neighbouring predetermined representatives '0' subsequent to group G3', i.e., G4'=[0 0 0 0] holds, wherein G5' comprises the neighbouring complementary representatives '1' subsequent to group G3', i.e., G5'=[1] holds, wherein G6' comprises the neighbouring predetermined representatives '0' subsequent to group G5, i.e., G6'=[0 0 0 0 0 0] holds. Thus, due this alternating assignment of the same neighbouring representatives to one group of the one or more groups, it may be assumed to be known that group G2' comprises at least one of the predetermined representative, and, if there are more than one groups, each of these further groups comprises at least one of complementary representative or predetermined representative, respectively, in an alternating order.

For instance, with respect to original string S1, a permutated string may be represented by S1-b=[G1 G1 G2' G3' G4' G5' G6'].

For instance, an encoding in accordance with an encoding scheme may be performed on each of the groups of the permutated string in order to determine said at least one encoded representative of the string, wherein the provided representation of the string does not comprise an encoded representative being associated with at least one of the at least one predetermined representative at the end of the permutated string. Thus, as an example, the encoding for determining the at least one encoded representative may not be performed with respect to the at least one of the at least one predetermined representative at the end of the permutated string. I.e., with respect to permutated string S1-a, no encoding may be performed with respect to the representatives "0 0 0 0 0 0" at the end of group G2, or, with respect permutated string S2, no encoding may be performed with respect to the representatives "0 0" at the end of group G2. Furthermore, for instance, encoding may be performed on all representatives of the string, but the provided representation does not comprise at least one of the encoded representatives being associated with the at least one of the at lease one predetermined representative at the of the permutated string, i.e., with respect to these example, not associated with at least one of the '0' at the end of group G2.

According to an exemplary embodiment of all aspects of the present invention, said function comprises checking if there is at least one of the predetermined representatives at the end of the string, and, if this checking yields a negative result, permutating representatives of the string.

If this checking yields a negative result, a permutation of representatives in the string is performed. This permutation is performed in a manner that after this permutation there is at least one predetermined representative at the end of the string. This permutation may comprise rearranging the representatives in the string in an ordered fashion.

As an example, an information being indicative of the result of this checking may be obtained and may be inserted in the representation of the string. Thus, this information may be transmitted to a decoder, wherein the decoder can determine whether a permutation has been performed based on this information. As an example, this information may be a bit indicating that said checking yielded in positive or a negative result. This information may be assumed to represent an information indicating whether a permutation is performed. Furthermore, for instance, if said checking yields a positive result, said information may comprise information indicative of the number of predetermined representatives at the end of the string.

For instance, said permutating may be performed based on permutating single representatives in the string in accordance with the rule of the set of rules. This rule may comprise a permutation function. Accordingly, for example, if the rule is known, the permutation of groups can be performed and/or can be reversed. As a non-limiting example, the string may be represented by S3=[1 0 0 1], wherein representative '0' may be considered to be the predetermined representative. The permutation may be performed by a permutation function. For instance, with respect to this non-limiting example, the permutation function may be (1 4 2 3), which permutates the original string S3=[1 0 0 1] into a permutated representation [1 1 0 0]. Thus, the permutation function may indicate the change of positions of the representatives when the permutation function is applied to the original string. For instance, the permutation function may be determined based on the string, wherein the permutation function may be chosen or may be optimized in a way that the permutated string comprises a maximized amount of the predetermined representatives at the end of the string. For instance, an indicator being indicative of the permutation function may be obtained and may be inserted in the representation of the string.

According to an exemplary embodiment of all aspects of the present invention, said permutating is performed based on at least one of: permutating at least two groups of representatives in the string, and permutating single representatives in the string.

For instance, said permutating may be performed based on at least two groups of representatives in the string. Each group of said at least two groups of representatives may comprise at least one representative, wherein said permutating may comprise rearranging the groups in the string in an ordered fashion. Thus, as an example, said permutating based on permutating at least two groups may be performed in accordance with the rule of the set of rules, wherein this rule may comprise a permutation function. Accordingly, for example, if the rule is known, the permutation of groups can be performed and/or can be reversed. The permutation function may be configured to rearrange the groups in the string in a manner that the group comprising the most of the predetermined representative at the end of this group is placed at the end of the string.

For instance, said predetermined representative is one of the first representative and the second representative and a complementary representative is the other of the first and second representative. For instance, an indicator being indicative of the permutation function may be obtained and may be inserted in the representation of the string.

According to an exemplary embodiment of all aspects of the present invention, said predetermined representative is one of the first and second representative and wherein a complementary representative is the other of the first and second representative, and wherein said permutating based on permutating at least two groups of representatives in the string comprises: classifying the string into at least two groups of representatives, wherein a last group of the at least two groups comprises the at least one complementary representative at the end of the string, and permutating the last group to another position in the string.

Said permutating based on permutating at least two groups of representatives may comprise classifying the string into at least two groups of representatives, wherein a last group of the at least two groups comprises the at least one complementary representative at the end of the string. This at least one complementary representative is in accordance with the negative result of checking if there is at least one of the predetermined representative at the end of the string. Then, this last group of the at least two groups is permutated to another position in the string, wherein another group is permutated to the end of the string, this another group comprises at least one of predetermined representative at the end of this group. Thus, this permutation ensures that there is at least one of the predetermined representative at the end of the string.

For instance, said classifying the string into at least two groups of representatives may comprise classifying the string into groups of neighbouring representatives, wherein each of the groups comprises either only first representatives or second representatives.

For instance, as a non-limiting example, the string may be represented by S1=[1 1 1 1 1 1 1 0 0 0 1 1 0 0 0 0 1 0 0 0 0 0 0 0 1 1 1 1], where '0' may be the first representative and '1' may be the second representative, wherein a first group G1 may comprise the second representatives at the beginning of the string, i.e., G1=[1 1 1 1 1 1 1 1] may hold, the next group G2 may comprise the consecutive first representatives in the string, i.e., G2=[0 0 0] may hold, the next group G3 may comprise the consecutive second representatives in the string, i.e., G3=[1 1] may hold, and so on, i.e., G4=[0 0 0 0], G5=[1], G6=[0 0 0 0 0 0] and G7=[1 1 1 1] may hold. Thus, the original string may be represented by the [G1 G2 G3 G4 G5 G6 G7].

As an example, the predetermined representative may be the first representative, i.e., '0', and the complementary representative may be the second representative, i.e., '1'. With respect to the exemplary classifying mentioned above, wherein a last group of the at least two groups comprises the at least one complementary representative at the end of the string, group G7 may be considered to represent this last group of the at least two groups. The permutation of groups may now be performed in a manner that this last group is permutated to another position in the string, wherein another group is permutated to the end of the string, this another group comprising the predetermined representatives. With respect to this example, one of groups G2, G4 and G6 may be permutated to the end of the string. As an example, the last group G7 may be inserted at the beginning of the string or between two neighbouring groups, wherein the subsequent group(s) after the inserted last group are shifted in the string. As another example, the group of the at least two groups comprising the most predetermined representatives at the end of this group may be permutated to the end of the string.

For instance, the last group G7 may be permutated to a new position between the first group G1 and the second group G2, such that the second group G2 and the subsequent groups G3 to G6 are shifted in the string, wherein group G6 may be shifted to the last position in the string. Thus, in this example, the string would be represented by [G1 G7 G2 G3 G4 G5 G6].

For instance, in case the checking if there is at least one of the predetermined representative at the end of the string yields a positive result, there may nevertheless be a permutation of representatives of the string. This permutation may be performed to maximize the amount of the predetermined representative at the end of the string and may be based on any of the above-mentioned permutations, i.e., based on permutating at least one group of representatives in the string and/or based on permutating single representatives in the string. It may then proceed with providing a representation of the string, wherein said representation comprises at least encoded representative.

For instance, said determining the representation of the string may comprise determining said at least one encoded representative based on an encoding scheme in accordance with the rule of the set of rules, wherein said encoding scheme is applied on the at least one group of representatives, said at least one group being out of the at least two groups of representatives in the string and exactly one group of representatives in the string.

Thus, for instance, in case exactly one group of representatives in the string is used for applying the encoding scheme, this group may comprise all representatives of the first and second representative of the string or it may comprise a subset of representatives of the first and second representatives in the string. As an example, this subset of representatives may comprise the representatives of the string except for at least one of the at least one predetermined representative at the end of the string. For instance, the subset of representatives may comprise the representatives of the string except for all of the at least one predetermined representatives at the end of the string.

Then, the respective encoding scheme which is associated with the rule may be applied to this group in order to determine said at least one encoded representative.

According to an exemplary embodiment of all aspects of the present invention, said determining the representation of a string comprises determining said at least one encoded representative based on an encoding scheme in accordance with the rule, wherein said encoding scheme is applied on the basis of at least one group of representatives, said at least one group being one out of: at least two groups of representatives of the string, and exactly one group of representatives of the string.

In case said at least two groups of representatives in the string are used for applying the encoding scheme, said at least two groups may represent groups of neighbouring representatives, wherein each group comprises one representative or at least two neighbouring representatives of the string.

For instance, these at least two groups of representatives for encoding may correspond to respective at least two groups of the at least two groups used for permutation. As an example, in case the permutation has been performed and the last group of the permutated string comprises only the predetermined representative, the at least two groups of representatives for encoding may correspond to the at least two groups of the permutated string except for the last group. If the permutated string comprises exactly two groups, then only the first group may be chosen as the above mentioned exactly one group of representatives used for encoding.

As a non-limiting example, when considering the above mentioned exemplary original string S1=[1 1 1 1 1 1 1 0 0 0 1 1 0 0 0 0 1 0 0 0 0 0 0 0 1 1 1 1], which may be grouped into groups G1, G2, . . . G7, and wherein the permutation may lead to a permutated string S1-c=[G1 G7 G2 G3 G4 G5 G6]. Now, for instance, the at least two groups of representatives used for encoding may be represented by G1, G7, G2 . . . G5, wherein the last group G6 of the permutated string may be neglected, since it exclusively comprises the predetermined representative '0'. Thus, the at least two groups G1, G7, G2 . . . G5 are encoded in accordance with the respective encoding scheme in order to determine the at least one encoded representative of the string. Accordingly, this at least one encoded representative is associated with the representatives in the at least two groups G1, G7, G2 . . . G5 of the string, but this at least one encoded representative is not associated with the at least one predetermined representative in group G6 at the end of the string.

For instance, said encoding scheme may be performed based on a run-length encoding. As an example, this run-length encoding may be performed on each group, i.e., on the exactly one group or on each of the at least two groups for encoding. The run-length encoding may comprise determining at least one indicator, wherein an indicator is indicative of the amount of subsequent same representatives in the string, i.e., which may be considered as the amount of repeated representatives. Thus, the at least one encoded representative comprises this determined at least one indicator.

As a non-limiting example, in accordance with one rule of the set of rule, the first indicator of the at least one indicator may be associated with the first or the second representative, wherein the subsequent indicators are associated with the second or the first representative in an alternating way.

For instance, the original string may be S3=[1 1 1 1 1 0 0 0 1 0 1 0 0 0 0 1 0 1 0 1 1 1 1 1 1 0 0 0], as depicted in FIG. 4*a*, wherein, as an example, exactly one group is used for encoding, this exactly one group not comprising at least one of the predetermined representative at the end of the string. For instance, this exactly one group may comprise all representatives of the string except for the last representatives being the predetermined representative, wherein this predetermined representative may be representative '0'. Accordingly, this exemplary exactly one group may be represented by [1 1 1 1 1 0 0 0 1 0 1 0 0 0 0 1 0 1 0 1 1 1 1 1 1]. A run-length encoding performed on this group may result in the at least one indicator [5 2 0 0 0 3 0 0 0 0 5], if the rule defines that the first indicator is associated with the second representative '1'. The first indicator '5' indicates that there five subsequent representatives being the second representative, wherein the second indicator '2' indicated that there are three subsequent first indicators. There must be at least one first representative after the succession of second representatives, thus, this second indicator and the subsequent indicators may only indicate the amount of additional same representatives, i.e., they may indicate the amount of subsequent same representatives minus one.

As another example, in case the rule does not define an association of the first indicator with a representative, a further indicator may indicate which representative is placed at the beginning of the string. E.g., in the above-mentioned example of exactly one group, this further indicator may represent a '1', wherein this further indicator and the at least one indicator of the run-length encoding may be summarized as the following representation:[1 4 2 0 0 0 3 0 0 0 0 5]. Since it is known due to the further indicator '1', which is exemplarily positioned at the beginning of the representation, that the first representative in the string is a '1', the first run-length indicator may be determined to be '4', because there are four additional same representatives '1' in addition to the first '1' in the string. The subsequent indicators [2 0 0 0 3 0 0 0 5] may be the same as in the preceding example.

For instance, in a similar way, a run-length encoding may be performed on each group of the at least two groups, if two our more groups are used for encoding.

Furthermore, as an example, said encoding scheme may apply further a priori information in accordance with the rule of the set of rules when determining the at least one encoded representative.

For instance, as mentioned above, said classifying the string into at least two groups of representatives may comprise classifying the string into groups of neighbouring representatives, wherein each of the groups comprises either only first representatives or second representatives. Accordingly, a group of these groups may be encoded with one representative.

With respect to the run-length encoding scheme, one group may be encoded by means of an indicator based on the cardinality of the group. For instance, this indicator may represent the exact value of the amount of representatives in the group, or, for instance, the amount of representatives in the group minus one. As a non-limiting example for a rule of a run-length encoding, the first and the last group of the non-permutated string may be encoded with the actual number of first representatives (or, alternatively, the second representatives), wherein other groups may be encoded with the actual number of representatives minus one. For instance, with respect to the example mentioned above, the permutated string may be [G1 G7 G2 G3 G4 G5 G6], wherein the at least two groups of representatives used for encoding may be represented by G1, G7, G2 . . . G5. Accordingly, with respect to the run-length encoding of the permutated string, group G1 may be encoded by an indicator associated with the amount of representatives in this group, group G7 may be encoded by an indicator associated with the amount of representatives in this group, and so on. Furthermore, there may be an indicator being indicative of the type of representative associated with one group, such that it can be reconstructed which of the groups G1, G7, G2 . . . G5 is associated with which representative.

Furthermore, with respect to the example presented regarding the permutated string S1-b=[G1 G1 G2 G3 G4 G5 G6], it is known to the rule that the last group G1 of the original string is exclusively associated with the complementary representative, wherein the same may hold for the first group G1 (alternatively, the first group may be associated with the predetermined representative, which may lead to a different classification of the subsequent groups). This information may be used as a priori information for encoding the groups. Accordingly, as an example, an encoded representative associated with the representatives of the last group may not comprise information of the type of representative in this group. The same may hold for an encoded representative associated with the first group. Furthermore, the information that each of the one or more groups G2 . . . G6 is associated with exclusively one type of representative in an alternating way may be used as a priori information for encoding. Thus, an encoded representative associated with the representatives of one of this one or more groups may not comprise information of the type of representative in the respective group. Furthermore, the information that each of the one or more groups comprises at least one representative may be used when determining an encoded representative associated with the representatives of one of this one or more groups.

For instance, in case of a run-length encoding, this permutated string S1-b may be encoded by means of the following indicators: [6 4 3 1 3 0], wherein indicator 6 indicates that there are six of the complementary representatives in the first group G1 and indicator 4 indicates that there are four of the complementary representatives in group G1. Since group G1 and group G1 may comprise zero representatives, the respective indicator associated with on of these groups indicates the real number of representatives in the respective group. The subsequent indicator 3 indicates that there are four of the predetermined representative '0' in group G2, since there must be at least one of the predetermined representative in group G2, indicator 1 indicates that there are two of the complementary representative in group G3, next indicator 3 indicates that there are 4 of the predetermined representative in group G4, and indicator 0 indicates that there is one of the complementary representative '1' in group G5. Accordingly, groups G1, G1, G2 . . . G5 in the permuted string can be reconstructed. The length of the string is known, thus the remaining positions can be filled with the predetermined representative. Accordingly, group G6 can also be reconstructed.

According to an exemplary embodiment of all aspects of the present invention, in accordance with one rule of the set of rules said determining at least one representative comprises for at least one group of the at least one group: determining at least one indicator of a respective distance between a respective starting position and a respective next position of the predetermined representative in the group in a respective direction in accordance with the rule, wherein said at least one indicative represents at least one encoded representative associated with the group, wherein the respective starting position associated with a first indicator of the at least one indicator is a predetermined starting position based on the rule, and, in case the at least one indicator represents at least two indicators, the respective starting position associated with a further indicator of the at least two indicators is based on one of: a further predetermined starting position based on the rule; and the respective next position of a predetermined representative associated with one preceding indicator.

This exemplary embodiment of all aspects of the present will be explained with respect to the following sixth, seventh, eight, ninth and tenth aspect of the invention, wherein the term 'string' used with respect to the sixth, seventh, eight, ninth and tenth aspect of the invention may be considered to represent the respective group for which at least one indicator of a distance between a respective starting position and a respective next position of the predetermined representative in the group in a respective direction in accordance with the rule is determined in accordance with this exemplary embodiment of the invention.

According to a sixth aspect of the present invention, a method is disclosed, comprising determining at least one indicator of a respective distance between a respective starting position and a respective next position of a predetermined representative in a string in a respective direction in accordance with a rule, the string comprising first and second representatives, the rule being one rule of a set of rules and the predetermined representative being one of the first and second representatives, wherein the respective starting position associated with a first indicator of the at least one indicator is a predetermined starting position based on the rule, and, in case the at least one indicator represents at least two indicators, the respective starting position associated with a further indicator of the at least two indicators is based on one of: a further predetermined starting position based on the rule; and the respective next position of a predetermined representative associated with one preceding indicator.

According to a seventh aspect of the present invention, an apparatus is disclosed, which is configured to perform the method according to the sixth aspect of the present invention, or which comprises means for performing the method according to the first aspect of the present invention, i.e. means for determining at least one indicator of a respective distance between a respective starting position and a respective next position of a predetermined representative in a string in a respective direction in accordance with a rule, the string comprising first and second representatives, the rule being one rule of a set of rules and the predetermined representative being one of the first and second representatives, wherein the respective starting position associated with a first indicator of the at least one indicator is a predetermined starting position based on the rule, and, in case the at least one indicator represents at least two indicators, the respective starting position associated with a further indicator of the at least two indicators is based on one of: a further predetermined starting position based on the rule; and the respective next position of a predetermined representative associated with one preceding indicator.

According to a eighth aspect of the present invention, an apparatus is disclosed, comprising at least one processor and at least one memory including computer program code, the at least one memory and the computer program code configured to, with the at least one processor, cause the apparatus at least to perform the method according to the first aspect of the present invention. The computer program code included in the memory may for instance at least partially represent software and/or firmware for the processor. Non-limiting examples of the memory are a Random-Access Memory (RAM) or a Read-Only Memory (ROM) that is accessible by the processor.

According to a ninth aspect of the present invention, a computer program is disclosed, comprising program code for performing the method according to the sixth aspect of the present invention when the computer program is executed on a processor. The computer program may for instance be distributable via a network, such as for instance the Internet. The computer program may for instance be storable or encodable in a computer-readable medium. The computer program may for instance at least partially represent software and/or firmware of the processor.

According to a tenth aspect of the present invention, a computer-readable medium is disclosed, having a computer program according to the ninth aspect of the present invention stored thereon. The computer-readable medium may for instance be embodied as an electric, magnetic, electro-magnetic, optic or other storage medium, and may either be a removable medium or a medium that is fixedly installed in an apparatus or device. Non-limiting examples of such a computer-readable medium are a RAM or ROM. The computer-readable medium may for instance be a tangible medium, for instance a tangible storage medium. A computer-readable medium is understood to be readable by a computer, such as for instance a processor.

In the following, features and embodiments pertaining to all of these above-described aspects of the present invention will be briefly summarized.

For instance, an input string may be obtained. This input string may for instance be obtained by reception, or may be internally obtained from a process or program that is executed by a processor. This process of program may for instance be part of an encoding process. Said input string may for instance be representative of at least a part of a speech, audio and/or video signal.

The input string comprises a sequence of at least one symbol, wherein each of the at least one symbol is taken from an alphabet comprising a first representative and a second representative. The term string may also be understood as a vector which comprises the sequence of at least one symbol. The length of the string may be limited, i.e. the string may comprise a predefined number symbols. To name an example, this alphabet may represent a binary alphabet, wherein the first representative may represent a '0' and the second representative may represent a '1' or vice versa. With respect to this example, the string may be considered to represent a binary string. As a non-limiting example, this binary alphabet may be used for a string comprising information of the position of null and non-null subvectors used for encoding.

At least one indicator of a respective distance between respective starting position and a respective next position of a predetermined representative in the string is determined in a respective direction in accordance with a rule. Thus, a respective indicator of the at least one indicator indicates the distance from the respective starting position to the next position of the predetermined representative in the respective direction in the string, wherein the respective starting position and the respective direction is associated with this respective indicator. As an example, a respective direction may represent a direction which extends upwardly in the string or a respective direction may represent a direction which extends downwardly in the string. For instance, this respective direction may be the same direction for each of the at least one indicator, or, alternatively, the respective direction may depend on the respective indicator. Thus, for instance, an indicator of the at least one indicator may be considered to be associated with the representatives in positions of the string starting from the respective starting position to (and including) the respective next position of the predetermined representative in the respective direction. Accordingly, as a non-limiting example, an indicator of the at least one indicator which indicates a distance of d, wherein $d \geq 0$ holds, may indicate that the string comprises d representatives being not the predetermined representatives, starting from the respective starting position and extending in the respective direction associated with this indicator (based on the rule), wherein the indicator further indicates that the string comprises the predetermined representative in a position shifted by d positions with respect to the starting position in the respective direction. Thus, for instance, a respective indicator may be associated with d+1 representatives, i.e., d representatives not being the predetermined representative and one predetermined representative.

The predetermined representative may represent either the first representative or the second representative. The predetermined representative may be fixed during determining the at least one indicator.

The respective starting position associated with a first indicator of the at least one indicator is a predetermined starting position based on the rule of the set of rules. For instance, this predetermined starting position may represent the first position in the string or it may represent the last position in the string.

Starting from the predetermined starting position the next predetermined representative in the respective direction may be determined, and the distance of the position of this next predetermined representative with respect to the starting position may be determined. A distance of zero may be determined in case the string comprises the predetermined representative in the starting position. This determined distance is associated with the first indicator of the at least one indicator. Thus, the first indicator of the at least one indicator is indicative of the distance between the predetermined starting position and the position of the next predetermined representative in the respective direction in the string.

The set of rules comprises at least one rule. For instance, a rule of the set of rules may be considered as a rule indicating a predefined manner of parsing the string in order to determine the at least one indicator.

For instance, one rule of the set of rules may define that the respective direction extends from the predetermined starting position to the other end of the string. This rule may for instance be considered as a first example of a rule. E.g., in case one rule defines that the predetermined starting position represents the first position in the string, the respective direction may extend upwardly in the string. Then, for example, the string may be parsed from the first position in upward direction, wherein the first indicator of the at least one indicator may be indicative of the distance between the first position and the position of the next predetermined representative in the respective direction in the string, and wherein each of the at least one further indicator may be indicative of an updated predetermined starting position and the position of the next predetermined representative in the respective direction in the string, wherein the updated predetermined starting associated with a respective further indicator may be based on the next position associated with the last determined indicator, i.e., the indicator which may have been determined immediately before the respective further indicator. By this way, the string may be parsed in upward direction, wherein the at least one determined indicator may be considered as a representation of the string which is based on the predetermined representative.

For instance, in case one rule defines that the predetermined starting position represents the last position in the string, the respective direction may extend downwardly in the string. This rule may for instance be considered as a second example of rule. Then, for example, the string may be parsed from the last position in downward direction, wherein the first indicator of the at least one indicator may be indicative of the distance between the last position and the position of the next predetermined representative in the respective direction in the string, and wherein each of at least one further indicator may be indicative of an updated predetermined starting position and the position of the next predetermined representative in the respective direction in the string, wherein the updated predetermined starting associated with a respective further indicator may be based on the next position associated with the last determined indicator, i.e., the indicator which may have been determined immediately before the respective further indicator. By this way, the string may be parsed in downward direction, wherein the at least one determined indicator may be considered as a representation of the string which is based on the predetermined representative.

Furthermore, there may exist a third example of a rule of the set of rules. For instance, this third example of a rule may define that the predetermined starting position is set to a first end of the string, such that the first indicator is determined to indicate the distance between this first end of the string and the next position of the predetermined representative in a first respective direction, which extends to the other end of the string (i.e., the second end). The next predetermined starting position associated with a second indicator of the at least one indicator may be set to the position of the second end of the string, and the second indicator of the at least one indicator may be determined to indicate the distance between this second and the next position of the predetermined representative in a second respective direction, which extends to the first end of the string. Then, a subsequent indicator of the at least one indicator may be determined to indicate the distance between a new starting position based on the next position associated with the first indicator and the next position of the predetermined representative in the first direction, and a further subsequent indicator of the at least one indicator may be determined to indicate the distance between a new starting position based on the next position associated with the second indicator and the next position of the predetermined representative in the second direction, such that the string may be parsed in an alternating way.

There may exist for instance further examples of a rule for parsing the string in predetermined manner.

Thus, the string may be parsed in accordance with one rule of the set of rules in a predetermined way in order determine at least one indicator, each of this at least one indicator being indicative of a distance between a respective predetermined starting position and the next position of the predetermined representative in a respective predetermined direction in the string. Accordingly, the at least one determined indicator may for instance be considered as a representation of the string based on determined distances between positions of neighbours of the predetermined representative in the string in accordance with a selected rule of the set of rules.

According to an exemplary embodiment of all aspects of the present invention, the determining at least one indicator comprises: setting the respective starting position to the predetermined starting point based on the rule; determining an indicator of a distance between the respective starting position and the next position of the predetermined representative in the string in the predetermined direction in accordance with the rule, the first indicator of the at least one indicator being this indicator; checking if there is a further representative in the string, and, if this checking yields a positive result: updating the respective starting position; and determining an indicator of a distance between the updated respective starting position and the next position of the predetermined representative in the string in a respective direction in accordance with the rule, and proceeding with checking if there is a further representative in the string, wherein the respective direction is one of the predetermined direction and a further predetermined direction.

For instance, in accordance with the first example of a rule, the respective starting position, which may be denoted as sp, which is associated with the first indicator, is set to the first position in the string. Then the first indicator of a distance between the starting position sp and a next position of the predetermined representative is determined in the respective direction in the string. In accordance with the first example of a rule, the respective direction extends upwardly. The next position of the predetermined representative with respect to starting point sp in the upward direction may be determined, wherein the next position may be denoted as np. Starting for instance at sp=0 in string, this next position np is determined to represent the next position where the next predetermined representative is located in the string, e.g. including the starting position sp itself.

For instance, an indicator of the at least one indicator may represent the respective distance by means of an integer number d, wherein d≥0 holds. Accordingly, with respect to an indicator indicating a distance d, the string comprises d symbols of the alphabet's representative not being the predetermined representative, starting from the respective position associated with the indicator in the respective direction, and the string comprises the predetermined representative in a position shifted from the respective starting position by d positions in the respective direction.

Thus, distance d associated with the first indicator may be determined by np-sp (or, in case of a rule with a respective direction extending downwardly, d=sp−np may hold). Accordingly, the first indicator may be considered as a representative of symbols $s_{sp}$ to $s_{np}$ in the string. Furthermore, for instance, a loop counter k may be initialized, e.g. by means of k=0, wherein the first indicator may be associated with index k=0.

Then it is checked whether there is a further representative in the string. A further representative may represent a representative in the string which is not associated with any of the indicators of the at least one indicator which have been determined so far. For instance, it may be checked whether the string comprises a representative, i.e., a symbol, which is not associated with any of the indicators $i_0$ to $i_k$. Or, for instance, in case of the first example of the rule, it may be checked if the actual next position $np_k$ is less than last position in the string (or, in case of a rule with a respective direction extending downwardly, if the actual next position $np_k$ is larger than the first position in the string). Furthermore, as another example, it may be checked whether there are any further of the predetermined representative in the string.

In case said checking yields in a positive result, it may be proceeded by updating the starting position to a new value. For instance, in case said checking yields in a positive result, the optional loop counter k may be incremented.

This updating the starting position may be performed in a manner that the string is parsed in accordance with the selected rule. For instance, with respect to the first example of a rule, the starting position may be set to a position based on the next position $np_k$ associated with the last determined indicator $i_{k-1}$ of a distance, wherein the starting position $sp_k$ may represent the next position in the respective position in the string, i.e., $sp_k=np_{k-1}+1$ may hold (or, in case of a rule with a respective direction extending downwardly, $sp_k=np_{k-1}-1$ may hold).

Or, for instance, with respect to the third example of a rule, in case k=1 the starting position may be set to the further predetermined starting position, and in case k>1 the starting position may be set based on the next position associated with the last determined indicator of a distance in the same direction as the direction associated with indicator k which is to be determined, i.e., the starting position $sp_k$ may be set based on $np_{k-2}$. For instance, in case indicator k is associated with a direction extending downwardly, the starting position $sp_k$ may represent the next position in the string in downward direction with respect to $np_{k-2}$, i.e., $s_{Pk}=np_{k-2}-1$ may hold, or, in case indicator k is associated with a direction extending upwardly, the starting position $sp_k$ may represent the next position in the string in upward direction with respect to $np_{k-2}$, i.e., $sp_k=np_{k-2}+1$ may hold.

Then, a further indicator $i_k$ of a distance between the starting position $sp_k$ and the next position $np_k$ of the predetermined representative in the respective direction associated with further indicator k is determined. In case of the first and second example of a rule, the respective direction does not change, but in case of the third example of a rule, the respective direction may change in an alternating way. For instance, in case index k associated with the actual indicator represents an even index (e.g, k=0, 2 . . . ), the respective direction may represent the first direction, and in case index k associated with the actual indicator represents an odd index (e.g, k=1, 3, . . . ), the respective direction may represent the second direction.

Thus, the string may be parsed in accordance with a selected rule until there is no further representative to be parsed in the string. Accordingly, the at least one determined indicator can be considered as a representation of the string.

According to an exemplary embodiment of all aspects of the present invention, in accordance with one rule of the set of rules the predetermined starting position associated with the first indicator represents the first position in the string, the predetermined direction extends upwardly, and the respective direction is the predetermined direction.

This rule may correspond to the first example of the rule.

According to an exemplary embodiment of all aspects of the present invention, in accordance with one rule of the set of rules the predetermined starting position associated with the first indicator represents the last position in the string and the predetermined direction extends downwardly, and the respective direction is the predetermined direction.

This rule may correspond to the second example of the rule.

According to an exemplary embodiment of all aspects of the present invention, wherein said updating the respective starting position comprises setting the respective starting position based on the respective next position associated with the last determined indicator of a distance.

Thus, for instance, in accordance with the above mentioned loop index k, updating the actual starting position $sp_k$ is based on the next position $np_{k-1}$ which is associated with the last determined indicator $i_{k-1}$.

According to an exemplary embodiment of all aspects of the present invention, in accordance with one rule of the set of rules the predetermined starting point associated with the first indicator represents the first position in the string and the predetermined direction extends upwardly, and wherein the further predetermined starting position represents the last position in the string and the further predetermined direction extends downwardly, and wherein the respective direction represents the further predetermined direction with respect to the indicator determined directly after the first indicator, and wherein for any further determined indicator, the respective direction alternates between the predetermined direction and the further predetermined direction.

This rule may correspond to a first alternative of the third example of the rule, wherein the string is parsed starting from the first position in the string (e.g., from left), i.e., wherein the first end of the string is the first position in the string and the second end of the string is the last position in the string, wherein the first direction extends upwardly and the second direction extends downwardly such that the string is parsed in an alternating way.

According to an exemplary embodiment of all aspects of the present invention, in accordance with one rule of the set of rules the predetermined starting point associated with the first indicator represents the last position in the string and the predetermined direction extends downwardly, and wherein the further predetermined starting position represents the first position in the string and the further predetermined direction extends upwardly, and wherein the respective direction represents the further predetermined direction with respect to the indicator determined directly after the first indicator, and wherein for any further determined indicator, the respective direction alternates between the predetermined direction and the further predetermined direction.

This rule may correspond to a second alternative of the third example of the rule, wherein the string is parsed starting from the last position in the string (e.g., from right), i.e., wherein the first end of the string is the last position in the string and the second end of the string is the first position in the string, wherein the first direction extends downwardly and the second direction extends upwardly such that the string is parsed in an alternating way.

According to an exemplary embodiment of all aspects of the present invention, said updating the respective starting position comprises setting the respective starting position to the further predetermined starting position with respect to the second indicator, and for any further indicator being determined after the first and second indicator: setting the respective starting position with respect to a respective indicator to based on the next position associated with the last determined indicator in the of a distance in the same direction as the direction associated with the respective indicator.

For instance, with respect to the third example of a rule and in accordance with the above mentioned loop index k, in case k=1 the starting position may be set to the further predetermined starting position, and in case k>1 the starting position may be set based on the next position associated with the last determined indicator of a distance in the same direction as the direction associated with indicator k to be determined, i.e., the starting position $sp_k$ may be set based on $np_{k-2}$.

According to an exemplary embodiment of all aspects of the present invention, a representation of the string which comprises at least one indicator of the determined at least one indicator is provided.

For instance, this representation may comprise each of the at least one determined indicator or the representation may comprise as many of the determined at least one indicator as necessary for a representation of the string. The representation may represent a vector or a string and the at least one indicator of the determined at least one indicator may be arranged in this vector or a string in a predefined manner, e.g. in accordance with the order of determining the at least one indicator.

Furthermore, the representation of the string may comprise a representative being indicative of the selected rule, i.e. the rule associated with the at least one indicator. For instance, if the set of rules contains exactly two rules, then one bit may be used for such a representative, but any other representative may also be used for indicating the rule. Accordingly, a decoder can identify the rule which has been used for determining the at least one indicator based on this representative. Based on this identified rule, the string may be reconstructed based on the representation of the string.

According to an exemplary embodiment of all aspects of the present invention, the representation comprises the at least one indicator except for the last indicator(s) indicating a distance of zero.

The last indicator or the last indicators may represent those indicators which have been determined lastly in accordance with the order of determining the at least one indicator. For instance, under the assumption that the length of the string may be known, the string may be reconstructed by means of this representation comprising the at least one indicator except for the last indicator(s) indicating a distance of zero, wherein the remaining symbol(s) in the string not being associated with these indicators in the representation can be filled with the predetermined representative, since in accordance with distance zero of the omitted indicator(s) this(these) remaining symbol(s) must represent the predetermined representative.

According to an exemplary embodiment of aspect one to five of the present invention, in accordance with one rule of the set of rules said determining at least one encoded representative comprises for at least one group of the at least one group: performing a run-length encoding in order to determine at least one encoded representative associated with the group.

According to an exemplary embodiment of aspects one to five of the present invention, said determining said at least one encoded representative is performed for each rule of the set of rules, such that each rule of the set of rules is associated with the respective representation comprising the respective at least one encoded representative.

According to an exemplary embodiment of aspects six to ten of the present invention, said determining at least one indicator of a respective distance is determined for each rule of the set of rules, such that each rule of the set of rules is associated with the respective at least one indicator.

For instance, the set of rules may comprise the first example of a rule, and/or the second example of a rule, and/or the third example of a rule, and or at least one further example of a rule.

Then, in accordance with the selected rule, at least one indicator of a respective distance between a respective starting position and the respective next position of a predetermined representative in a string is determined for each rule of the set of rules.

For instance, a representation of the string associated with each rule of the set of rules may be provided, wherein the representation may be determined as mentioned above and comprises at least one indicator of the determined at least one indicator associated with the respective rule.

According to an exemplary embodiment of all aspects of the present invention, for each rule of the set of rules, it is determined which respective at least one indicator associated with a respective rule is well-suited for encoding.

Well-suited may be understood in a manner that the respective at least one indicator associated with a respective rule is determined to be well-suited which represents the most compact representation of the string, i.e., for instance, the representation that may be encoded with the fewest amount of bits. For instance, this determining which respective at least one indicator associated with a respective rule is well-suited for encoding may be performed based on the respective representation of the string associated with the respective rule. I.e., in this case, the respective representation associated with a respective rule is determined to be well-suited which represents the most compact representation of the string.

This well-suited representation may be selected for further processing. For instance, this well-suited representation may comprise a representative which indicates the associated rule.

According to an exemplary embodiment of aspects one to five of the present invention, said determining said encoded representation is performed for each rule of the set of rules, such that each rule of the set of rules is associated with the respective encoded representation.

This determining of the string comprises determining said at least one encoded representative based on an encoding scheme in accordance with the selected rule, wherein said encoding scheme is applied on the basis of at least one group of representatives, said at least one group being out of: at least two group of representatives of the string, and exactly one group of representatives. With regard to this groupwise encoding it is referred to the examples mentioned above in accordance with the first to fifth aspect of the invention. For instance, the encoding scheme may represent a run-length encoding, or the encoding based on the fifth to tenth aspect of the invention may be applied, or any other well-suited encoding scheme.

According to an exemplary embodiment of all aspects of the present invention, a vector is splitted into at least two subvectors, an encoding is performed for each of the at least two subvectors, the string is provided, wherein the string comprises at least one of the first representative and at least one of the second representative, each of the at least one first representative indicating a null vector of a respective one of the at least two encoded subvectors and each of the at least one second representative indicating a non-null vector of a respective one of the at least two encoded subvectors.

For instance, with respect to the exemplary embodiment of the first to fifth aspect of the invention, this string may represent the string on which the function is applied to ensure that the string comprises at least one of a predetermined representative at the end of the string, and wherein the representation of the string is determined, the representation comprising at least one encoded representative. For instance, in accordance with the selected rule a run-length encoding may be applied for the encoding scheme, or the encoding based on the exemplary embodiment of the sixth aspect to the tenth aspect of the invention may be applied, or another well-suited encoding scheme.

Furthermore, for instance, in accordance with another rule, the string may represent the string of the exemplary embodiment of the sixth aspect to the tenth aspect of the invention (in case these aspects do not depend on the exemplary embodiment of the first aspect to the sixth aspect of the invention), wherein a representation of this string in accordance with the rule comprises at least one indicator of a respective distance between a respective starting position and the respective next position of a predetermined representative in a string.

The vector may comprise a plurality of coefficients. Each of the at least one subvector may comprise at least one coefficient.

This vector may represent any vector comprising data to be encoded. For instance, this may be audio data or video data or other data. For instance, incase of video data this vector may comprise coefficients from at least one transform coefficient block of an image to be encoded, e.g., the coefficients of significant transform coefficient blocks.

For instance, as a non-limiting example, this vector may represent a vector obtained during an Adaptive Multi-Rate (AMR)-Wideband (WB) encoding, wherein a Modified Discrete Cosine Transformation (MDTC) is performed on a difference signal and the transform coefficients are encoded. For instance, encoding of these transform coefficients for a bitstream may include encoding a vector comprising a plurality of coefficients with a predetermined amount of bits per bitstream. For instance, as a non-limiting example, a vector may comprise 280 coefficients, wherein this vector is encoded with 160 bits per bitstream. As an example, this vector comprising 280 coefficients may be split into 10 dimensional subvectors resulting in 28 subvectors. Any other well-suited splitting of the vector into the at least two subvectors may also be performed.

As an example, before splitting the vector, optional further processing may be performed to the vector. For instance, this further processing may include calculating the standard deviation of the vector data, and normalizing the vector data by the standard deviation multiplied by a given scale factor, wherein an initial value of the overall gain may then for instance be given be the product between the standard deviation and the given scale factor. An overall gain may for instance be estimated based on the subvector energy distribution.

The encoding of the subvectors may be performed by means of a plurality of codevectors, wherein each of the subvector is encoded with a codevector from the plurality of codevectors. For instance, the nearest codevector from the plurality of codevectors may be used for encoding a respective subvector. The plurality of codevectors may comprise one codevector representing a null codevector.

For instance, it may be determined which of the at least two encoded subvectors are represented by a null codevector, and for each of the encoded subvectors being represented by a null vector, the first representative is inserted in a respective position in the string, the respective position being associated with the respective encoded subvector. Thus, a first representative at position n in the string may indicate that the n-th subvector of the at least two subvectors is encoded by means of a null codevector. Furthermore, for instance, the remaining positions in the string may be filled with the second representative. Thus, a second representative at position n in the string may indicate that the n-th subvector of the at least two subvectors is quantized by means of a non-null codevector. For instance, this string may be considered as a representative indicating the positions of null codevectors and non-null codevectors used for quantizing the at least two subvectors, wherein each of the at least two subvectors is either encoded by means of null codevector or a non-null codevector.

After the string has been provided, a representation of the string is obtained.

For instance, in case this aspect of the invention depends on one of the first to fifth aspect of the invention, the obtained representation of the string comprises the at least one encoded representative, wherein said representation does not comprise an encoded representative being associated with at least one of the at least one predetermined representative at the end of the string. This determining of the string comprises determining said at least one encoded representative based on an encoding scheme in accordance with the selected rule, wherein said encoding scheme is applied on the basis of at least one group of representatives, said at least one group being out of: at least two group of representatives of the string, and exactly one group of representatives. With regard to this groupwise encoding it is referred to the examples mentioned above in accordance with the first to fifth aspect of the invention. For instance, the encoding scheme may represent a run-length encoding, or the encoding based on the fifth to tenth aspect of the invention may be applied, or any other well-suited encoding scheme.

For instance, in case this aspect of the invention depends on one of the sixth to tenth aspect of the invention, this representation of the string may be obtained based on the determined at least one indicator in accordance with one rule as mentioned above. For instance, the predetermined representative in the string may represent the first representative of the provided string, or it may represent the second representative of the provided string.

For instance, at least two representations may be provided, each of the at least two representation being associated with a different rule, and wherein the well-suited representation of the string is determined based on these at least two representations.

Thus, the representation of the string may be considered as encoded string based on at least one indicator of a respective distance between a respective starting position and the respective next position of the predetermined string.

According to an exemplary embodiment of all aspects of the present invention, said encoding represents a lattice quantization.

For instance, it is possible to define a lattice codebook as a union of leader classes, each of which is characterized by a leader vector.

Codebooks used within speech and audio codecs may for instance be based on lattice structures, as described in reference "Multiple-scale leader-lattice VQ with application to LSF quantization" by A. Vasilache, B. Dumitrescu and I. Tabus, Signal Processing, 2002, vol. 82, pages 563-586, Elsevier, which is incorporated herein in its entirety by reference.

A leader vector is an n-dimensional vector (with n denoting an integer number), whose (positive) components are ordered (e.g. decreasingly). The leader class corresponding to the leader vector then consists of the leader vector and all vectors obtained through all the signed permutations of the leader vector (with some possible restrictions). It is also possible that one, some or all leader classes are respectively associated with one or more scales, and the lattice codebook is then formed as a union of scaled and/or unscaled leader classes. For instance, a D10+ lattice may be considered for quantization, but any other well-suited lattice quantization may also be considered.

A subvector may for instance be quantized by finding the nearest neighbor code vector in the codebook, i.e. the code vector that has the smallest distance with respect to the subvector. An identifier of this code vector (e.g. a codevector index assigned to this code vector) then may serve as a quantized representation of the subvector.

For instance, finding the nearest neighbor code vector in the codebook may comprise for each of the at least two subvectors identifying a leader vector of the plurality of leader vectors, the identified leader vector representing the nearest leader vector with respect to the respective subvector, and identifying the nearest code vector of the plurality of code vectors in the leader vector class associated with the identified leader vector. The identified leader vector for a respective subvector may be represented by a leader vector representation. This leader vector representation may for instance represent a leader vector index.

The codevector index within the leader vector class may for instance be obtained through an enumeration algorithm as described in reference WO 2009/100768 A1, which is incorporated herein by reference.

According to an exemplary embodiment of all aspects of the present invention, the representation of the string is encoded; and a leader vector representation and a code vector representation for each of the at least two quantized subvectors being associated with a non-null vector are encoded.

The encoded representation of the string may be represented by a binary encoded representation of the string. For instance, a Golomb Rice encoding may be performed for encoding the representation of the string, wherein an additional bit may be inserted in the encoded representation of the string, this additional bit being indicative of the selection of a Golomb Rice parameter used for encoding.

Furthermore, the leader vector representations and code vector representations are encoded for each of the at least two quantized subvectors being associated with a non-null vector.

For instance, the leader vector representation of each of the at least two quantized subvectors being associated with a non-null vector may be encoded using a Huffmann code, or a Golomb Rice code, wherein the Rice parameter may be dependent on the subvector index or may be optimized for the current frame values.

Accordingly, the encoded representation of the string and the encoded leader vector representation and encoded codevector representations may be considered as encoded representation of the input vector.

According to an exemplary embodiment of all aspects of the present invention, a bitstream which comprises an encoded representation of the input vector is provided, wherein the encoded representation of the input vector is based on the representation of the string and on information for each of the at least two encoded subvectors being associated with a non-null vector.

As an example, the frame may correspond to the number of samples from a time domain signal that are encoded at the same time 't'.

For instance, for a frame there may be a bitstream in an encoded signal, i.e., the frame may be inserterted as a bitstream in the encoded signal. For instance, for each frame of a plurality of frames there may be a corresponding bitstream in the encoded signal. Thus, as an example, this bitstream may be provided to be transmitted to any kind of receiver or decoder. The number of bits available for a frame is actually the length of the bitstream corresponding to that frame.

For instance, the encoded information for each of the at least two encoded subvectors may represent the respective code vector (representing a non-null codevector). Under a non-limiting assumption, this encoded information for a respective encoded subvector may represent the encoded leader vector representation and the encoded code vector representation for quantizing the respective subvector.

Thus, for instance, the representation of the string and the information for each of the at least two encoded subvectors being associated with a non-null vector may be inserted in the bitstream. As another example, the encoded representation of the string and the information for each of the at least two encoded subvectors being associated with a non-null vector may be inserted in the bitstream.

As a non-limiting example, the representation of the string and the information for each of at least two encoded subvectors being associated with a non-null vector may be inserted in an alternating way in the bitstream. This insertion in an alternating way may for instance comprise inserting an indicator (or the encoded indicator) of the representation of the string in the bitstream, and, if this indicator is associated with at least one non-null vector of the at least two encoded subvectors, the information for each of the at least one encoded subvector associated with this at least one non-null vector is subsequently inserted in the bitstream. Then, the next indicator (or encoded indicator) of the representation of the string may be inserted in the bitstream, and, if this indicator is associated with at least one non-null vector of the at least two encoded subvectors, the information for each of the at least one encoded subvector associated with this at least one non-null vector is subsequently inserted in the bitstream. In this way, each indicator (or encoded indicator) of the representation of the string is inserted in the bitstream, and, for each of these indicators, in case the respective indicator is associated with at least one non-null vector of the at least two encoded subvectors, the information for each of the at least one encoded subvector associated with this at least one non-null vector is inserted subsequently to the respective indicator in the bitstream before the next indicator (or next encoded indicator) is inserted in the bitstream. If this filling has been finished and there are still bits left in the bitstream (or one bit is left), these bits (or this bit) may be filled with zeros or with or with codewords corresponding to null vectors.

Thus, even in case the length of the encoded representation of the string (or the length of string) is not explicitly known and the representation of the string comprises the at least one indicator except for the last indicator(s) indicating a distance of zero, as described above, the string may be reconstructed.

For instance, under the assumption that the representation of the string has been determined based on the first to fifth aspect of the invention, at a decoder, a received bitstream may be decoded in the following way: The encoded representatives of the representation of the string may be extracted from the bitstream. Furthermore, for instance, in case the representation comprises information indicating whether a permutation is performed, this information may be extracted from the bitstream and/or information indicating the rule of the set of rules may be extracted. In accordance with the rule and the corresponding decoding scheme, which may be applied on exactly one group of representatives in the string or on at least two groups of representatives in the string, the extracted encoded representations are encoded and may be inserted in a decoded representative of the string. Since the length of the string is known to the decoder, the remaining positions in the decoded representative of the string are filled with the predetermined representative. Afterwards, it may be checked whether there has been performed a permutation on the string, e.g., based on the extracted information whether a permutation has been performed, and a re-permutation is performed on the representatives of the decoded representation of the string. Finally, the representatives in the decoded representation are used to reconstruct the null vectors and non-null vectors. For instance, it may be checked if the first representative in the decoded representation is associated with a non-null vector. If this checking yields in a negative result, a null vector may be inserted in a decoded vector at a position associated with the respective representative. If this checking yields a positive result, the respective encoded subvector is read from the bitstream, may be decoded and may be inserted in the decoded vector. In this way, for instance, for each of the representatives in the decoded representation it may be checked if the respective representative is associated with a non-null vector, and, if this checking yields in a negative result for a respective representative, a null vector may be inserted in a decoded vector at a position associated with the respective representative, and, if this checking yields a positive result, the respective encoded subvector is read from the bitstream, may be decoded and may be inserted in the decoded vector. As mentioned above, the encoding/decoding may be performed based on run-length encoding or on the method according to the third (or subsequent) embodiment of the invention or any other well-suited encoding/decoding.

For instance, under the assumption that the representation of the string has been determined based on the sixth to tenth aspect of the invention, at a decoder, a received bitstream may be decoded in the following way: The first indicator may be extracted from the bitstream. This extraction may comprise decoding the first indicator in case it was inserted as an encoded indicator in the bitstream. Then it may be checked whether this indicator is associated with a non-null vector. If this checking yields in a negative result, the indicator is decoded to represent a null vector and this null vector may be inserted in a decoded vector at a position associated with the respective indicator and the respective rule (which may have been detected based on the received bitstream). If this checking yields in a positive result, i.e., if the respective indicator indicates a distance d larger than zero, the next d information of the d encoded subvectors is read from the bitstream and the respective d subvectors may be decoded and may be inserted in the decoded vector. The next subcodevector or codevector corresponding the next subvector is decoded to represent a null vector, as indicated by the respective indicator, wherein this null vector may be inserted in the decoded vector subsequently after the d encoded subvectors. Then, it may be proceeded with the next indicator in the received bitstream.

Accordingly, the vector may be reconstructed even in case that the representation of the string, which has been used for inserting in the bitstream at the encoder, may comprise the at least one indicator except for the last indicators indicating a distance of zero. In this case, for instance, under the assumption that the number of subvectors is known at the decoder, after the last indicator has been read from the bitstream and, if this last indicator indicates a distance larger than zero, the associated information of the d encoded subvectors is read from the bitstream, the rest of subvectors, which are not associated with the indicators in the received bitstream, must necessarily represent null vectors which may be inserted in the decoded vector.

Regarding the above mentioned optional Golomb Rice encoding of the leader vector representation of each of the at least two quantized subvectors being associated with a non-null vector, for instance for subvectors at the beginning or at the end of the vector the Rice parameter may be 1 while for subvectors in middle of the vector the Rice parameter may be 0.

Furthermore, it may for instance be checked whether the total number of bits of an encoded representation of the input vector is less than or equal to the number of bits of a bitstream. For instance, this may be performed before the encoding of the representation of the encoded input vector is determined. This bitstream may represent a bitstream configured for storing or transmitting the encoded representation of the input vector. The number of bits for the bitstream may be fixed. For instance, the bitstream may comprise 160 bits, as mentioned above, but the bitstream may comprise any predefined number of bits.

For instance, under assumption of the optional lattice quantization, the number of bits to encode the representation of the string and the bits for leader vectors and codevector indexes for the non-null subvectors may be counted. Thus, as an example, only the number of bits needed to encode the representation of the string may be counted, but the info on the total number of bits available for the bitstream may be not used, wherein the fact used is that the representation of the string does not comprise the at least one predetermined representative at the end of the string. Accordingly, the encoding of the positions of the non-null codevectors requires at least this number of bits.

Then, the checking may be performed based on the number of bits which have been counted to encode the representation of the string and the number of bits for leader vectors and codevector indexes for the non-null subvectors.

If this checking yields a negative result, it may be proceeded with reducing the number of bits used for a first encoded representation of the input vector. For instance, under the assumption of the optional lattice quantization, this reduction of number of bits used for the first encoded representation of the input vector may be achieved by quantizing at least one of the at least two subvectors using leader vectors that use less number of bits. The number of bits considered to be used when encoding with a given leader vector is the sum between the bits used to encode the leader vector representative and the number of bits to encode the codevector representation from the given leader vector class. Thus, at least one of the at least two subvectors may be quantized using an other leader vector and another codevector, wherein this codevector is determined from the codevectors of the leader vector class of the other leader vector in order to reduce the number of bits for encoding the at least one of the at least two subvectors.

For instance, the decision which at least one of the at least two subvectors may be quantized by another leader vector (and another codevector) may be performed based on a gradient approach. For instance, the gradient approach described in reference WO 2007/046027 A1, which is incorporated herein by reference, may be applied for deciding which at least one of the at least two subvectors may be quantized by an other leader vector (and another codevector).

The size-reduced first encoded representation may then for instance be inserted in the bitstream. For instance, the above mentioned alternated insertion may be applied. Furthermore, a distortion of this first encoded representation may be determined, which may be performed as explained in the sequel.

Then, the number of bits may be counted again, based on the number of bits which have been counted to encode the representation of the string and the number of bits for leader vectors and codevector indexes for the non-null subvectors.

If this checking performed yields a positive result, the encoded representation of the input vector may for instance be inserted in the bitstream or, if the input vector has not been encoded so far, the encoded representation of the input vector may be determined and be inserted in the bitstream. A distortion of the first encoded representation may be determined. This distortion of the first encoded representation may represent a value being a representative of the distortion between the encoded first representation of the input vector and the input vector. The distortion between any vectors may for instance be computed according to a distance metric, as for instance a Minkowski metric, such as an Euclidean metric, a Manhattan metric or a Chebychev metric, to name but a few non-limiting examples. For instance, if the number of bits of the encoded representation of the input vector is less than then number of bits of the bitstream, the remaining bits in the bitstream may be filled with zeros or with codewords corresponding to null vectors.

Afterwards, it may for instance proceed with rescaling the input vector. This rescaling may be performed in a manner that the energy of the rescaled input vector is larger the energy of the input vector before rescaling. Then, a second encoded representation of the input vector, i.e., based on the rescaled input vector, may be obtained. For instance, this second representation of the input vector may be obtained similarly as the obtaining the representation of the input vector mentioned above.

Then, it may proceed with checking whether the total number of bits of this second encoded representation of the input vector is less than or equal to a number of available bits.

If this checking yields a negative result, it may proceed with reducing the number of bits for the second encoded representation of the input vector. This reduction of size of the second encoded representation of the input vector may be performed similarly as mentioned above.

Then, the distortion of the second encoded representation is determined, which may be performed as mentioned above. If the checking whether the total number of bits of this second encoded representation of the input vector is less than or equal to a number of available bits yields a positive result, the size of the second encoded representation is not reduced and it may directly proceed with determining the distortion of the second encoded representation. Otherwise, the distortion of the size-reduced second encoded presentation may be determined.

Afterwards, it is checked whether the distortion of the first encoded representation is less than the distortion of the second encoded representation.

If this checking yields a positive result, the first encoded representation may be selected for insertion in the bitstream, and if this checking yields a negative result, the second encoded representation may be selected for insertion in the bitstream.

According to an exemplary embodiment of all aspects of the present invention, the bitstream is a binary representation with a fixed bitlength and wherein said encoded representation of the input vector, wherein the method comprises filling the bitstream with codewords corresponding to null vectors, i.e., corresponding to zeros in the original binary string, if the number of bits of the encoded representation of the input vector is less than the fixed bitlength. For instance, dependent on the encoding scheme, a codeword corresponding to a null vector may be represented by one zero, e.g. in case of the encoding in accordance with the sixth to tenth aspect of the invention is applied. Thus, with respect to this sixth to tenth aspect, an inserted zero would stand for a distance of zero being associated with one null vector. For instance, in case the encoding scheme is based on run-length encoding, the bitstream may be filled with codewords corresponding to null vectors.

According to an exemplary embodiment of all aspects of the present invention, said determining at least one indicator forms part of a Third Generation Partnership Project speech and/or audio codec, in particular an Enhanced Voice Service codec.

According to an exemplary embodiment of all aspects of the present invention, the apparatus comprises at least one of a user interface and an antenna.

Other features of all aspects of the invention will be apparent from and elucidated with reference to the detailed description of embodiments of the invention presented hereinafter in conjunction with the accompanying drawings. It is to be understood, however, that the drawings are designed solely for purposes of illustration and not as a definition of the limits of the invention, for which reference should be made to the appended claims. It should further be understood that the drawings are not drawn to scale and that they are merely intended to conceptually illustrate the structures and procedures described therein. In particular, presence of features in the drawings should not be considered to render these features mandatory for the invention.

DETAILED DESCRIPTION OF EMBODIMENTS OF THE INVENTION

Embodiments of the Invention Relate to

Figure 1A:
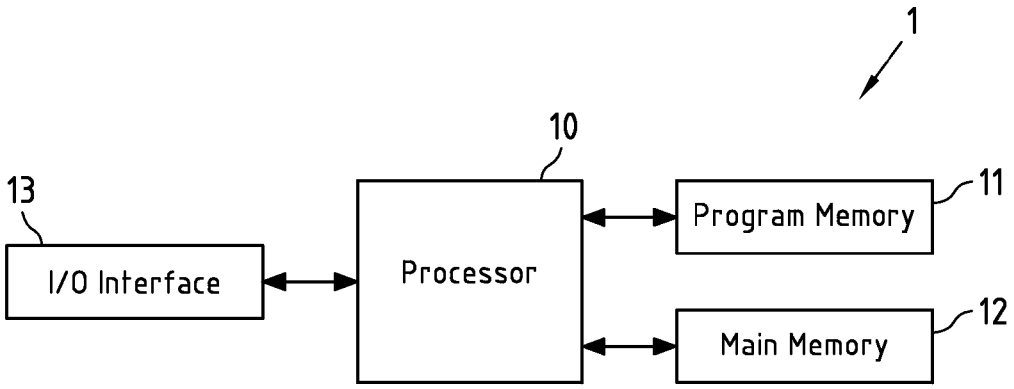
FIG. 1*a*: A schematic illustration of an apparatus according to an embodiment of the invention.

FIG. 1 schematically illustrates components of an apparatus 1 according to an embodiment of the invention. Apparatus 1 may for instance be an electronic device that is for instance capable of encoding at least one of speech, audio and video signals, or a component of such a device. Apparatus 1 is in particular configured to determine at least one indicator of a respective distance between a respective starting position and a respective position of a next predetermined representative in a string. Apparatus 1 may for instance be embodied as a module. Non-limiting examples of apparatus 1 are a mobile phone, a personal digital assistant, a portable multimedia (audio and/or video) player, and a computer (e.g. a laptop or desktop computer).

Apparatus 1 comprises a processor 10, which may for instance be embodied as a microprocessor, Digital Signal Processor (DSP) or Application Specific Integrated Circuit (ASIC), to name but a few non-limiting examples. Processor 10 executes a program code stored in program memory 11, and uses main memory 12 as a working memory, for instance to at least temporarily store intermediate results, but also to store for instance pre-defined and/or pre-computed databases. Some or all of memories 11 and 12 may also be included into processor 10. Memories 11 and/or 12 may for instance be embodied as Read-Only Memory (ROM), Random Access Memory (RAM), to name but a few non-limiting examples. One of or both of memories 11 and 12 may be fixedly connected to processor 10 or removable from processor 10, for instance in the form of a memory card or stick.

Processor 10 further controls an input/output (I/O) interface 13, via which processor receives or provides information to other functional units.

As will be described below, processor 10 is at least capable to execute program code for determining at least one indicator of a respective distance between a respective starting position and the respective position of a next predetermined representative in a string. However, processor 10 may of course possess further capabilities. For instance, processor 10 may be capable of at least one of speech, audio and video encoding, for instance based on sampled input values. Processor 10 may additionally or alternatively be capable of controlling operation of a portable communication and/or multimedia device.

Apparatus 1 of FIG. 1 may further comprise components such as a user interface, for instance to allow a user of apparatus 1 to interact with processor 10, or an antenna with associated radio frequency (RF) circuitry to enable apparatus 1 to perform wireless communication.

The circuitry formed by the components of apparatus 1 may be implemented in hardware alone, partially in hardware and in software, or in software only, as further described at the end of this specification.

Figure 1B:
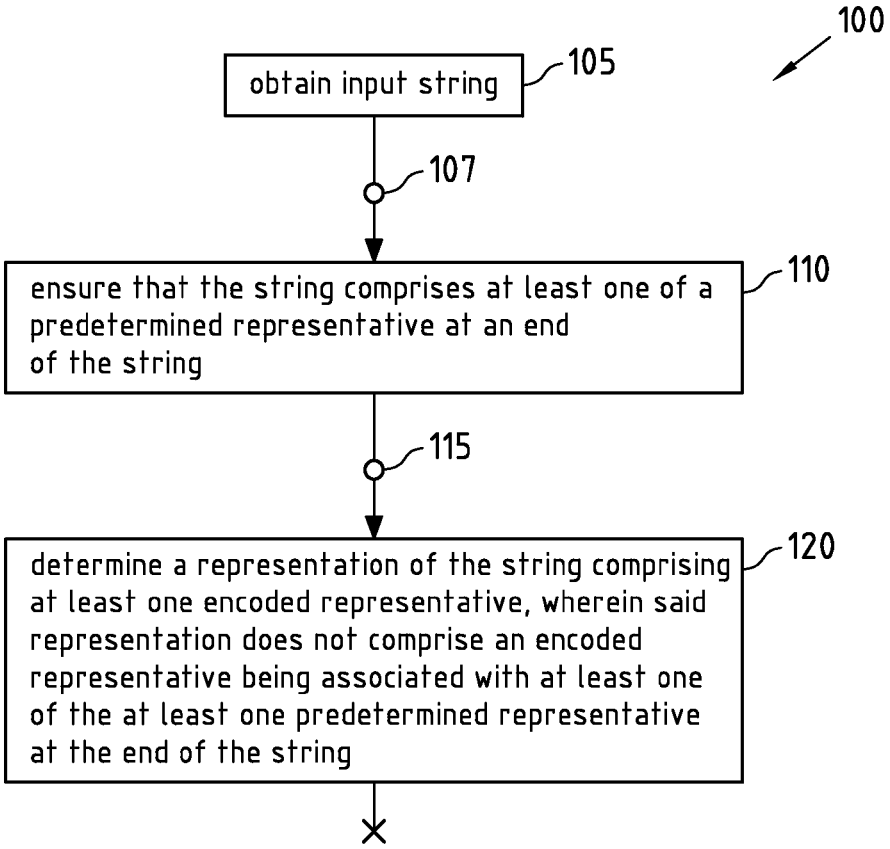
FIG. 1*b*: a flowchart of a method according to a first embodiment of the invention.
Figure 3:
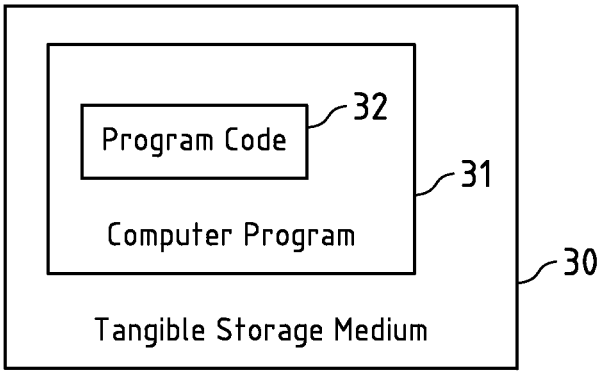
FIG. 3: a tangible storage medium according to an embodiment of the invention.

FIG. 1*b* shows a flowchart 100 of a method according to a first embodiment of the invention. The steps of this flowchart 100 may for instance be defined by respective program code 32 of a computer program 31 that is stored on a tangible storage medium 30, as shown in FIG. 3. Tangible storage medium 30 may for instance embody program memory 11 of FIG. 1, and the computer program 31 may then be executed by processor 10 of FIG. 1. These explanations also hold for the methods according to further embodiments of the invention presented in the sequel.

Returning to FIG. 1*b*, in a step 105, an input string is obtained. This input string may for instance be obtained by reception (for instance via I/O interface 13 of FIG. 1), or may be internally obtained from a process or program that is executed by processor 10. This process of program may for instance be part of an encoding process. Said input string may for instance be representative of at least a part of a speech, audio and/or video signal.

The input string comprises a sequence of at least one symbol, wherein each of the at least one symbol is taken from an alphabet comprising a first representative and a second representative. The term string may also be understood as a vector which comprises the sequence of at least one symbol. The length of the string may be limited, i.e. the string may comprise a predefined number symbols. To name an example, this alphabet may represent a binary alphabet, wherein the first representative may represent a '0' and the second representative may represent a '1' or vice versa. With respect to this example, the string may be considered to represent a binary string. As a non-limiting example, this binary alphabet may be used for a string comprising information of the position of null and non-null subvectors used for encoding.

In a step 110, a function is applied on the string in accordance with a rule of a set of rules, wherein the function ensures that the string comprises at least one predetermined representative at the end of the string after the function has been applied. For instance, the predetermined representative may be the first representative or the second representative, wherein the rule of the set of rules may define the predetermined representative. The function ensures that the string comprises at least one predetermined representative at the end of the string, i.e., there is one predetermined representative at the end of the string or at least two predetermined representatives at the end of the string, wherein the at least two predetermined representatives are at least two neighbouring representatives of the predetermined representative. Thus, the at least one predetermined representative at the end of the string is represented by a succession of at least one of the predetermined representative at the end of this string.

For instance, the end of the string may represent the right end of the string or the left end of the string, wherein the right end of the string may be represented by the last representatives in the string and the left end of the string may be represented by the first representatives in the string (or vice versa). Furthermore, for instance, the end of the string may be a predefined position in the string.

The function, which ensures that there is at least one predetermined representative at an end of the string, may comprise checking if there is at least one of the predetermined representative at the end of the string. Thus, for instance, in case there is at least one of the predetermined representative at the end of the string obtained in step 105, it is ensured that there is at least one predetermined representative at the end of string. Furthermore, the function may comprise permutating at least one representative in the string in a manner that after this permutation there is at least one predetermined representative at the end of the string. This permutation may be performed in accordance with the rule of the set of rules, i.e., a rule of the set of rules may be associated with a respective permutation.

In a step 120, a representation of the string is provided, wherein said representation comprises at least one encoded representative, each of said at least one encoded representative being associated with at least one representative in the string, wherein said representation does not comprises an encoded representative being associated with at least one of the at least one predetermined representative at the end of the string.

Accordingly, the representation of the string may comprise at least one encoded representative, wherein each of this at least one encoded representative is associated with on or more representatives of the string, but no of this at least one encoded representative is associated with at least one of the at least one predetermined representative at the end of the string. Nevertheless, a reconstruction of the string may for instance be possible by means of decoding the encoded representatives of the representation, thereby generating the representatives of the string except for the at least one of the at least one predetermined representative at the end of the string, and filling the remaining positions at the end of the string with the predetermined representative in accordance with the rule. For instance, it may be assumed that the length of the string is known. As an example, said at least one of the at least one predetermined representative at the end of the string may be all of the at least one predetermined representative at the end of the string.

Said determining a representation of a string may comprise an encoding for determining at least one encoded representative, but said determining may also be understood that said at least one encoded representative has already been encoded and is selected for providing the representation of the string. For instance, an encoding be performed based on all representatives in the string in order to determine a set of encoded representatives, wherein for determining the representation of the string only those encoded representatives are selected from the set of encoded representatives which are not associated with at least one of the at least one predetermined representative at the end of the string. The encoding may be performed by means of any well-suited encoding. For instance and as non-limiting example, this encoding may be based on a run-length encoding or on another encoding scheme.

For instance, said predetermined representative is one of the first and second representatives and a complementary representative is the other of the first and second representative. Said function may comprise classifying the string into at least two groups of representatives, each of said at least two groups comprising no or at least one representative of the string, wherein, a last group of the at least two groups is associated with at least one complementary representative at the end of the string, if possible, and permutating the last group to another position in the string.

Thus, the last group may be associated with all of the complementary representatives at the end of the string. If there are no complementary representatives at the end of the group, then this last group may be represented as empty group. Accordingly, due to the permutation of the last group comprising all the complementary representatives at the end of the string to another position in the string, i.e., to the beginning of the string or between two other groups of the string, it is ensured that the permutated string comprises at least one of the predetermined representatives at the end of the string.

Furthermore, for instance, a first group may be associated with at least one or with all of the complementary representatives at the beginning of the string, and, one or more groups may be associated with the representatives of the string between the first group and the last group. Then, the last group is permutated to the beginning of the string or to a position between the first group one of the one or more group. For instance, the last group may be permutated to a position between the first group and the subsequent group.

As a non-limiting example, the predetermined representative may be representative '0' and the complementary representative may be representative '1' (another assignment may also possible), wherein, for instance, the original string may be represented by S1=[1 1 1 1 1 1 1 0 0 0 1 1 0 0 0 0 1 0 0 0 0 0 0 0 1 1 1 1].

Thus, for instance, the last group may be associated with the last four complementary representatives '1' at the end of the string, i.e., G1 may be considered as last group, wherein G1=[1 1 1 1] holds. Furthermore, for instance, the first group may be associated with the six complementary representatives '1' at the beginning of the string, i.e., G1 may be considered as first group, wherein G1=[1 1 1 1 1 1] holds. The representatives in the original string between the first and last group may be associated with one or more groups. For instance, a second group G2 may comprise the representatives between the first group G1 and the last group G1, i.e., G2=[0 0 0 1 1 0 0 0 0 1 0 0 0 0 0 0 0] may hold.

The last group G1 of the original string is permutated to another position in the string. For instance, as exemplarily mentioned above, the last group may be permutated between the first group G1 and the subsequent group G2. Thus, the permutated string may be represented by S1-a=[G1 G1 G2].

As another non-limiting example, the original string may be represented by S2=[1 1 1 1 1 1 1 0 0 0 1 1 0 0 0 0 1 0 0 0 0 0 0 0 1 1 1 0 0].

Thus, for instance, the last group may be associated with no representative since there are two of the predefined representatives at the end of the string, but no one of the complementary representative of at the end of the string. I.e, G1 may be considered as last group, wherein G1=[ ] holds.

Furthermore, for instance, the first group may be associated with the six complementary representatives '1' at the beginning of the string as mentioned, i.e., G1 may be considered as first group, wherein G1=[1 1 1 1 1 1] holds. The representatives in the original string between the first and last group may be associated with one or more groups. For instance, a second group G2 may comprise the representatives between the first group G1 and the last group G1, i.e., G2=[0 0 0 1 1 0 0 0 0 1 0 0 0 0 0 0 0 1 1 1 1 0 0] may hold.

The last group G1 of the original string is permutated to another position in the string. For instance, as exemplarily mentioned above, the last group may be permutated between the first group G1 and the subsequent group G2. Thus, the permutated string may be represented by S2-a=[G1 G1 G2]. Furthermore, the one or more groups in the original string between the first group and the last group may be classified in a way, that each of this one or more group comprises either only first representatives or second representatives.

For instance, with respect to exemplary original string S1, this one or more group may be represented by groups G2', G3', G4', G5', G6', wherein G2' comprises the neighbouring predetermined representatives '0' subsequent to group G1, i.e., G2'=[0 0 0] holds, wherein G3' comprises the neighbouring complementary representatives '1' subsequent to group G2', i.e., G3'=[1 1] holds, wherein G4' comprises the neighbouring predetermined representatives '0' subsequent to group G3', i.e., G4'=[0 0 0 0] holds, wherein G5' comprises the neighbouring complementary representatives '1' subsequent to group G3', i.e., G5'=[1] holds, wherein G6 comprises the neighbouring predetermined representatives '0' subsequent to group G5', i.e., G6'=[0 0 0 0 0 0 0] holds. Thus, due this alternating assignment of the same neighbouring representatives to one group of the one or more groups, it may be assumed to be known that group G2' comprises at least one of the predetermined representative, and, if there are more than one groups, each of these further groups comprises at least one of complementary representative or predetermined representative, respectively, in an alternating order.

For instance, with respect to original string S1, a permutated string may be represented by S1-b=[G1 G1 G2' G3' G4' G5' G6'].

For instance, an encoding in accordance with an encoding scheme may be performed on each of the groups of the permutated string in order to determine said at least one encoded representative of the string, wherein the provided representation of the string does not comprise an encoded representative being associated with at least one of the at least one predetermined representative at the end of the permutated string. Thus, as an example, the encoding for determining the at least one encoded representative may not be performed with respect to the at least one of the at least one predetermined representative at the end of the permutated string. I.e., with respect to permutated string S1-a, no encoding may be performed with respect to the representatives "0 0 0 0 0 0 0" at the end of group G2, or, with respect permutated string S2, no encoding may be performed with respect to the representatives "0 0" at the end of group G2. Furthermore, for instance, encoding may be performed on all representatives of the string, but the provided representation does not comprise at least one of the encoded representatives being associated with the at least one of the at least one predetermined representative at the end of the permutated string, i.e., with respect to this example, not associated with at least one of the '0' at the end of group G2.

Further examples for encoding will be presented in the sequel.

Figure 1C:
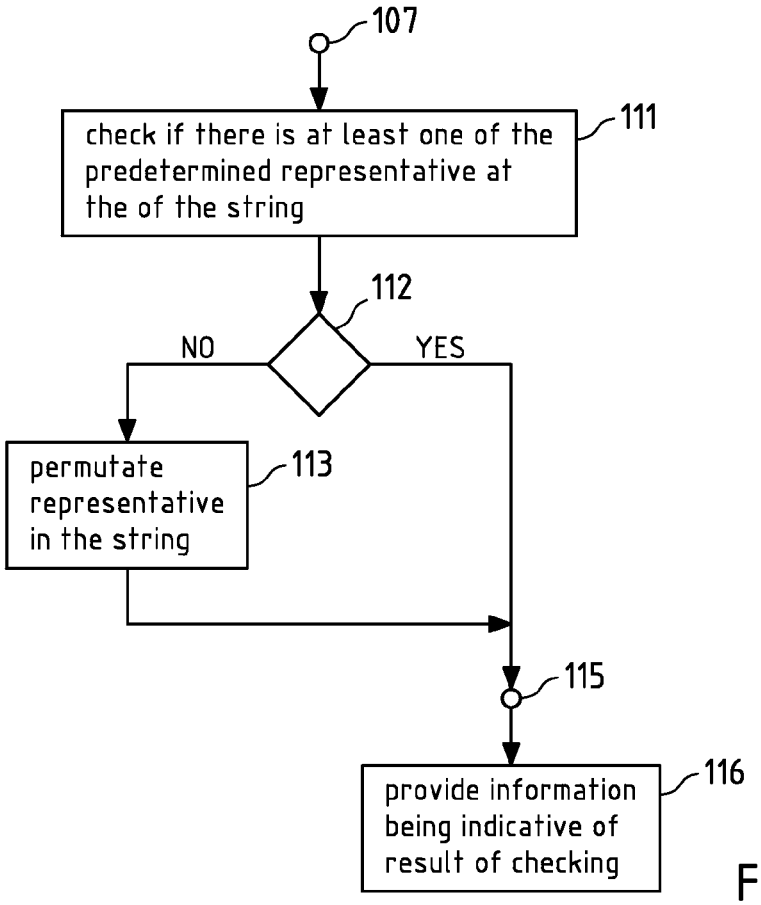
FIG. 1*c*: a flowchart of a method according to a second embodiment of the invention.

FIG. 1*c* shows a flowchart 100' of a method according to a second embodiment of the invention. As indicated by reference signs 107 and 115, this method according to a second embodiment of the invention may be used for ensuring that the string comprises at least one predetermined representative at an end of the string.

As an example, an information being indicative of the result of this checking may be obtained in step 116 and may be inserted in the representation of the string. Thus, this information may be transmitted to a decoder, wherein the decoder can determine whether a permutation has been performed based in this information. As an example, this information may be a bit indicating that said checking yielded in positive or a negative result. This information may be assumed to represent an information indicating whether a permutation is performed. Furthermore, for instance, if said checking yields a positive result, said information may comprise information indicative of the number of predetermined representatives at the end of the string.

In step 111, it is checked if there is at least one predetermined representative at the end of the string.

If this checking yields a negative result, a permutation of representatives in the string is performed in step 113. This permutation is performed in a manner that after this permutation there is at least one predetermined representative at the end of the string. This permutation may comprise rearranging the representatives in the string in an ordered fashion.

For instance, said permutating may be performed based on permutating single representatives in the string in accordance with the rule of the set of rules. This rule may comprise a permutation function. Accordingly, for example, if the rule is known, the permutation of groups can be performed and/or can be reversed. As a non-limiting example, the string may be represented by S3=[1 0 0 1], wherein representative '0' may be considered to be the predetermined representative. The permutation may be performed by a permutation function (1 4 2 3), which permutates the original string S3=[1 0 0 1] into a permutated representation [1 1 0 0], wherein the permutation function may indicate the change of positions of the representatives when the permutation function is applied to the original string. For instance, the permutation function may be determined based on the string, wherein the permutation function may be chosen or may be optimized in a way that the permutated string comprises a maximized amount of the predetermined representatives at the end of the string.

For instance, said permutating performed in step 113 may be performed based on at least two groups of representatives in the string. Each group of said at least two groups of representatives comprises at least one representative, wherein said permutating may comprise rearranging the groups in the string in an ordered fashion. Thus, as an example, said permutating based on permutating at least two groups may be performed in accordance with the rule of the set of rules, wherein this rule may comprise a permutation function.

Accordingly, for example, if the rule is known, the permutation of groups can be performed and/or can be reversed. The permutation function may be configured to rearrange the groups in the string in a manner that the group comprising the most of the predetermined representative at the end of this group is placed at the end of the string.

For instance, said predetermined representative is one of the first representative and the second representative and a complementary representative is the other of the first and second representative. Said permutating based on permutating at least two groups of representatives may comprise classifying the string into at least two groups of representatives, wherein a last group of the at least two groups comprises the at least one complementary representative at the end of the string. This at least one complementary representative is in accordance with the negative result of checking if there is at least one of the predetermined representative at the end of the string in step 111. Then, this last group of the at least two groups is permutated to another position in the string, wherein another group is permutated to the end of the string, this another group comprises at least one of predetermined representative at the end of this group. Thus, this permutation ensures that there is at least one of the predetermined representative at the end of the string.

As an example, an indicator being indicative of the permutation function may be obtained and may be inserted in the representation of the string.

For instance, said classifying the string into at least two groups of representatives may comprise classifying the string into groups of neighbouring representatives, wherein each of the groups comprises either only first representatives or second representatives.

For instance, as a non-limiting example, the string may be represented by S1=[1 1 1 1 1 1 1 0 0 0 1 1 0 0 0 0 1 0 0 0 0 0 0 0 1 1 1], where '0' may be the first representative and '1' may be the second representative, wherein a first group G1 may comprise the second representatives at the beginning of the string, i.e., G1=[1 1 1 1 1 1 1] may hold, the next group G2 may comprise the consecutive first representatives in the string, i.e., G2=[0 0 0] may hold, the next group G3 may comprise the consecutive second representatives in the string, i.e., G3=[1 1] may hold, and so on, i.e., G4=[0 0 0 0], G5=[1], G6=[0 0 0 0 0 0] and G7=[1 1 1 1] may hold. Thus, the original string may be represented by the [G1 G2 G3 G4 G5 G6 G7].

As an example, the predetermined representative may be the first representative, i.e., '0', and the complementary representative may be the second representative, i.e., '1'. With respect to the exemplary classifying mentioned above, wherein a last group of the at least two groups comprises the at least one complementary representative at the end of the string, group G7 may be considered to represent this last group of the at least two groups. The permutation of groups may now be performed in a manner that this last group is permutated to another position in the string, wherein another group is permutated to the end of the string, this another group comprising the predetermined representatives. With respect to this example, one of groups G2, G4 and G6 may be permutated to the end of the string. As an example, the last group G7 may be inserted at the beginning of the string or between two neighbouring groups, wherein the subsequent group(s) after the inserted last group are shifted in the string. As another example, the group of the at least two groups comprising the most predetermined representatives at the end of this group may be permutated to the end of the string.

For instance, the last group G7 may be permutated to a new position between the first group G1 and the second group G2, such that the second group G2 and the subsequent groups G3 to G6 are shifted in the string, wherein group G6 may be shifted to the last position in the string. Thus, in this example, the string would be represented by [G1 G7 G2 G3 G4 G5 G6].

Returning to FIG. 1*c*, the permutating performed in step 113 may ensure that at least one of the predetermined representative is at the end of the string.

For instance, in case the checking if there is at least one of the predetermined representative at the end of the string yields a positive result in step 112, there may nevertheless be a permutation of representatives of the string. This permutation may be performed to maximize the amount of the predetermined representative at the end of the string and may be based on any of the above-mentioned permutations, i.e., based on permutating at least one group of representatives in the string and/or based on permutating single representatives in the string. As indicated by reference sign 115 in FIG. 1*c* and returning to FIG. 1*b*, it may then proceed with providing a representation of the string, wherein said representation comprises at least one encoded representative.

Returning to FIG. 1*b* and to the method according to the first embodiment of the invention, said providing the representation of the string may comprise determining said at least one encoded representative based on an encoding scheme in accordance with the rule of the set of rule, wherein said encoding scheme is applied on the based of at least one group of representatives, said at least one group being one out of the at least two groups of representatives in the string and exactly one group of representatives in the string.

Thus, for instance, in case exactly one group of representatives in the string is used for applying the encoding scheme, this group may comprise all representatives of the first and second representative of the string or it may comprise a subset of representatives of the first and second representatives in the string. As an example, this subset of representatives may comprise the representatives of the string except for at least one of the at least one predetermined representative at the end of the string. For instance, the subset of representatives may comprise the representatives of the string except for all of the at least one predetermined representatives at the end of the string.

Then, the respective encoding scheme which is associated with the rule is applied to this group in order to determine said at least one encoded representative.

In case said at least two groups of representatives in the string are used for applying the encoding scheme, said at least two groups may represent groups of neighbouring representatives, wherein each group comprises one representative or at least two neighbouring representatives of the string.

For instance, with respect to the embodiment depicted in FIG. 1*c*, these at least two groups of representatives for encoding may correspond to respective at least two groups of the at least two groups used for permutation. As an example, in case the permutation has been performed and the last group of the permutated string comprises only the predetermined representative, the at least two groups of representatives for encoding may correspond to the at least two groups of the permutated string except for the last group. If the permutated string comprises exactly two groups, then only the first group may be chosen as the above mentioned exactly one group of representatives used for encoding.

As an example, when considering the above mentioned exemplary original string S1=[1 1 1 1 1 1 1 0 0 0 1 1 0 0 0 0 1 0 0 0 0 0 0 0 1 1 1 1], which may be grouped into groups G1, G2, . . . G7, and wherein the permutation may lead to a permutated string S1-c=[G1 G7 G2 G3 G4 G5 G6]. Now, for instance, the at least two groups of representatives used for encoding may be represented by G1, G7, G2 . . . G5, wherein the last group G6 of the permutated string may be neglected, since it exclusively comprises the predetermined representative '0'. Thus, the at least two groups G1, G7, G2 . . . G5 are encoded in accordance with the respective encoding scheme in order to determine the at least one encoded representative of the string. Accordingly, this at least one encoded representative is associated with the representatives in the at least two groups G1, G7, G2 . . . G5 of the string, but this at least one encoded representative is not associated with the at least one predetermined representative in group G6 at the end of the string.

For instance, said encoding scheme may be performed based on a run-length encoding. As an example, this run-length encoding may be performed on each group, i.e., on the exactly one group or on each of the at least two groups for encoding. The run-length encoding may comprise determining at least one indicator, wherein each indicator is indicative of the amount of subsequent same representatives in the string. Thus, the at least one encoded representative comprises this determined at least one indicator.

As a non-limiting example, in accordance with one rule of the set of rules, the first indicator of the at least one indicator may be associated with the first or the second representative, wherein the subsequent indicators are associated with the second or the first representative in an alternating way.

Figures 4A, 4B, 4C, 4D:
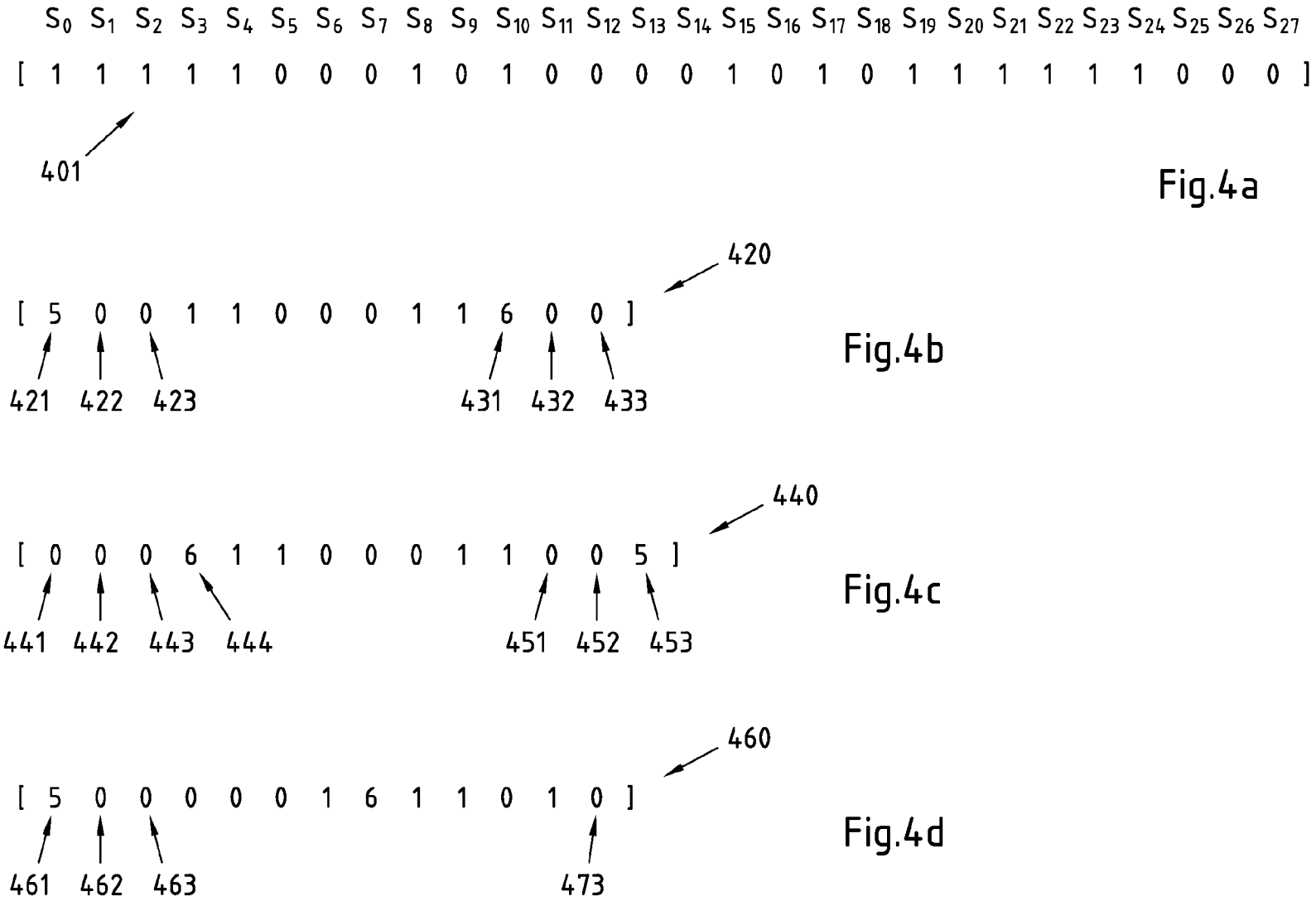
FIG. 4*a*: a representation of an example of a string.
FIG. 4*b*: a representation of an example of at least one indicator according to a first example of a rule.
FIG. 4*c*: a representation of an example of at least one indicator according to a second example of a rule.
FIG. 4*d*: a representation of an example of at least one indicator according to a third example of a rule.

For instance, the original string may be S3=[1 1 1 1 1 0 0 0 1 0 1 0 0 0 0 1 0 1 0 1 1 1 1 1 1 0 0 0], as depicted in FIG. 4*a*, wherein, as an example, exactly one group is used for encoding, this exactly one group not comprising at least one of the predetermined representative at the end of the string. For instance, this exactly one group may comprise all representatives of the string except for the last representatives being the predetermined representative, wherein this predetermined representative may be representative '0'. Accordingly, this exemplary exactly one group may be represented by [1 1 1 1 1 0 0 0 1 0 1 0 0 0 0 1 0 1 0 1 1 1 1 1 1]. A run-length encoding performed on this group may result in the at least one indicator [5 2 0 0 0 3 0 0 0 0 5], if the rule defines that the first indicator is associated with the second representative '1'. The first indicator '5' indicates that there are five subsequent representatives being the second representative, wherein the second indicator '2' indicated that there are three subsequent first indicators. There must be at least one first representative after the succession of second representatives, thus, this second indicator and the subsequent indicators may only indicate the amount of additional same representatives, i.e., they may indicate the amount of subsequent same representatives minus one.

As another example, in case the rule does not define an association of the first indicator with a representative, a further indicator may indicate which representatives is placed at the beginning of the string. E.g., in the above-mentioned example of exactly one group, this further indicator may represent a '1', wherein this further indicator and the at least one indicator of the run-length encoding may be summarized as the following representation:[1 4 2 0 0 0 3 0 0 0 0 5]. Since it is known due to the further indicator '1', which is exemplarily positioned at the beginning of the representation, that the first representative in the string is a '1', the first run-length indicator may be determined to be '4', because there are four additional same representatives '1' in addition to the first '1' in the string. The subsequent indicators [2 0 0 0 3 0 0 0 5] may be the same as in the preceding example.

For instance, in a similar way, a run-length encoding may be performed on each group of the at least two groups, if two or more groups are used for encoding.

Furthermore, as an example, said encoding scheme may apply further a priori information in accordance with the rule of the set of rules when determining the at least one encoded representative.

For instance, as mentioned above, said classifying the string into at least two groups of representatives may comprise classifying the string into groups of neighbouring representatives, wherein each of the groups comprises either only first representatives or second representatives. Accordingly, a group of these groups may be encoded with one representative.

With respect to the run-length encoding scheme, one group may be encoded by means of an indicator based the cardinality of the group. For instance, this indicator may represent the exact value of the amount of representatives in the group, or, for instance, the amount of representatives in the group minus one. As a non-limiting example for a rule of a run-length encoding, the first and the last group of the non-permutated string may be encoded with the actual number of first representatives (or, alternatively, the second representatives), wherein other groups may be encoded with the actual number of representatives minus one. For instance, with respect to the example mentioned above, the permutated string may be [G1 G7 G2 G3 G4 G5 G6], wherein the at least two groups of representatives used for encoding may be represented by G1, G7, G2 . . . G5. Accordingly, with respect to the run-length encoding of the permutated string, group G1 may be encoded by an indicator associated with the amount of representatives in this group, group G7 may be encoded by an indicator associated with the amount of representatives in this group, and so on. Furthermore, there may be in indicator being indicative of the type of representative associated with one group, such that it can be reconstructed which of the groups G1, G7, G2 . . . G5 is associated with which representative.

Furthermore, with respect to the example presented regarding the permutated string S1-b=[G1 G1 G2 G3 G4 G5 G6], it is known to the rule that the last group G1 of the original string is exclusively associated with the complementary representative, wherein the same may hold for the first group G1 (alternatively, the first group may be associated with the predetermined representative, which may lead to a different classification of the subsequent groups). This information may be used as a priori information for encoding the groups. Accordingly, as an example, an encoded representative associated with the representatives of the last group may not comprise information of the type of representative in this group. The same may hold for an encoded representative associated with the first group. Furthermore, the information that each of the one or more groups G2 . . . G6 is associated with exclusively one type of representative in an alternating way may be used as a priori information for encoding. Thus, an encoded representative associated with the representatives of one of this one or more groups may not comprise information of the type of representative in the respective group. Furthermore, the information that each of the one or more group comprises at least one representative may be used when determining an encoded representative associated with the representatives of one of this one or more groups.

For instance, in case of a run-length encoding, this permutated string S1-b may be encoded by means of the following indicators: [6 4 3 1 3 0], wherein indicator 6 indicates that there are six of the complementary representatives in the first group G1 and indicator 4 indicates that there are four of the complementary representatives in group G1. Since group G1 and group G1 may comprise zero representatives, the respective indicator associated with on of these groups indicates the real number of representatives in the respective group. The subsequent indicator 3 indicates that there are four of the predetermined representative '0' in group G2, since there must be at least one of the predetermined representative in group G2, indicator 1 indicates that there are two of the complementary representatives in group G3, next indicator 3 indicates that there are 4 of the predetermined representatives in group G4, and indicator 0 indicates that there is one of the complementary representative '1' in group G5. Accordingly, groups G1, G1, G2 . . . G5 in the permuted string can be reconstructed. The length of the string is known, thus the remaining positions can be filled with the predetermined representative. Accordingly, group G6 can also be reconstructed.

Figure 2A:
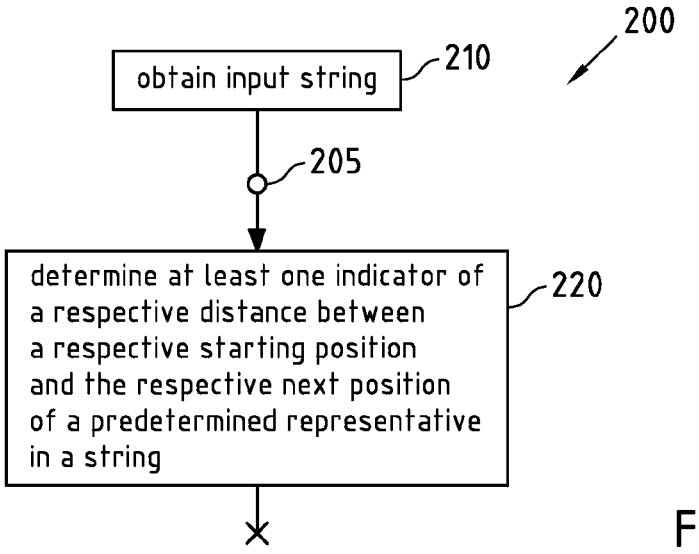
FIG. 2*a*: a flowchart of a method according to a third embodiment of the invention.

FIG. 2*a* shows a flowchart 200 of a method according to a third embodiment of the invention. The steps of this flowchart 200 may for instance be defined by respective program code 32 of a computer program 31 that is stored on a tangible storage medium 30, as shown in FIG. 3. Tangible storage medium 30 may for instance embody program memory 11 of FIG. 1, and the computer program 31 may then be executed by processor 10 of FIG. 1. These explanations also hold for the methods according to further embodiments of the invention presented in the sequel.

Returning to FIG. 2*a*, in a step 210, an input string is obtained. This input string may for instance be obtained by reception (for instance via I/O interface 13 of FIG. 1), or may be internally obtained from a process or program that is executed by processor 10. This process of program may for instance be part of an encoding process. Said input string may for instance be representative of at least a part of a speech, audio and/or video signal.

The input string comprises a sequence of at least one symbol, wherein each of the at least one symbol is taken from an alphabet comprising a first representative and a second representative. The term string may also be understood as a vector which comprises the sequence of at least one symbol. The length of the string may be limited, i.e. the string may comprise a predefined number symbols. To name an example, this alphabet may represent a binary alphabet, wherein the first representative may represent a '0' and the second representative may represent a '1' or vice versa. With respect to this example, the string may be considered to represent a binary string. As a non-limiting example, this binary alphabet may be used for a string comprising information of the position of null and non-null subvectors used for encoding.

In a step 220, at least one indicator of a respective distance between respective starting position and a respective next position of a predetermined representative in the string is determined in a respective direction in accordance with a rule. Thus, a respective indicator of the at least one indicator indicates the distance from the respective starting position to the next position of the predetermined representative in the respective direction in the string, wherein the respective starting position and the respective direction is associated with this respective indicator. As an example, a respective direction may represent a direction which extends upwardly in the string or a respective direction may represent a direction which extends downwardly in the string. For instance, this respective direction may be the same direction for each of the at least one indicator, or, alternatively, the respective direction may depend on the respective indicator.

Thus, for instance, an indicator of the at least one indicator may be considered to be associated with the representatives in positions of the string starting from the respective starting position to (and including) the respective next position of the predetermined representative in the respective direction. Accordingly, as a non-limiting example, an indicator of the at least one indicator which indicates a distance of d, wherein $d \geq 0$ holds, may indicate that the string comprises d representatives being not the predetermined representatives, starting from the respective starting position and extending in the respective direction associated with this indicator (based on the rule), wherein the indicator further indicates that the string comprises the predetermined representative in a position shifted by d positions with respect to the starting position in the respective direction.

Furthermore, in accordance with the rule, the predetermined representative may represent one representative of the first representative and the second representative.

The respective starting position associated with a first indicator of the at least one indicator is a predetermined starting position based on the rule. For instance, this predetermined starting position may represent the first position in the string or it may represent the last position in the string.

With respect to the example of a string 410 depicted in FIG. 4*a*, this string 410 may represent a binary string comprising a plurality of symbols $s_0$ to $s_n$, wherein in this example, without any limitation, n=27 holds. Thus, in case the predetermined starting position represents the first position in string 410, it represents position 0 associated with symbol $s_0$, and in case the predetermined starting position represents the last position in string 410, it represents position n associated with symbol $s_n$, i.e., $s_{27}$. Furthermore, with respect to the example of a string 410 depicted in FIG. 4*a*, the predetermined representative may represent '0', but the predetermined representative may also alternatively represent '1'.

The set of rules comprises at least one rule. For instance, a rule of the set of rules may be considered as a rule indicating a predefined manner of parsing the string in order to determine the at least one indicator.

For illustrative purposes and without any limitation, the method according to the third embodiment of the invention will now be explained for a first example of a selected rule, wherein the predetermined representative is a '0', the predetermined starting position is the first position in the string and the respective direction represents a direction extending upwardly in the string 401. FIG. 4*b* shows the determined at least one indicator 421, 422, 423 to 422 in accordance with this first example of a selected rule.

According to this first example of a selected rule for the third embodiment of method 200, a first indicator 421 of the at least one indicator 421 . . . 432 is determined, the first indicator 421 representing the distance between the respective starting position, i.e., the predetermined starting position, and the respective next position of the predetermined representative in string 401, i.e., the position of the next '0'. In this example, the predetermined starting position represents position 0 associated with symbol $s_0$. With respect to this predetermined starting position, the next position of representative '0' is in position 5 (symbol $s_5$). Accordingly, the first indicator 421 is determined to indicate distance 5 with respect to the predetermined starting position. An indicator may be considered as a representative of the symbols in the string between the respective starting position and the position of the next predetermined representative in the respective direction. I.e., the first indicator 421 may be considered as a representative of symbols $s_0$, $s_1$ to $s_5$, wherein distance 5 indicates that the next predetermined representative '0' in string 421 is in a position shifted by this distance in the respective direction with respect to the respective starting position. For instance, as depicted in FIG. 4*b*, an indicator of the at least one indicator 421, 422 to 432 may represent the respective distance by means of an integer number d, wherein d≥0 holds. Accordingly, with respect to an indicator indicating a distance d, the string comprises d symbols of the alphabet's representative not being the predetermined representative, starting from the respective position associated with the indicator in the respective direction, and the string comprises the predetermined representative in a position shifted from the respective starting position by d positions in the respective direction.

With respect to FIG. 4*b*, the at least one indicator represents at least two indicators 421 . . . 432.

According to this first example of a selected rule for the third embodiment of method 200, a further indicator 422 of the at least two indicators 421 . . . 432 is determined, the further indicator 422 representing the distance between the respective starting position and the respective next position of the predetermined representative in string 410, i.e., the next position of representative '0'. The respective starting position associated with this second indicator 422 represents a starting position based on the position of the predetermined representative associated with one preceding indicator of the at least two indicator 421 . . . 432. I.e., in this example, the preceding indicator may represent the first indicator 421 and thus, the respective starting position of further indicator 422 may be based on the next position of the predetermined representative of the first indicator 421, i.e., based on position 5 in this example. Since the respective direction extends upwardly in the string in this example, the respective starting position of the further indicator may represent the subsequent position in the string after the position of the next predetermined representative of the first indicator, i.e., the respective starting position of the further indicator may be position 6.

Starting at position 6 in string 401, the next position of predetermined representative '0' is determined to be 6, since symbol $s_6$ represent a '0'. Accordingly, the further indicator 422 is determined to indicate a distance 0. In this way, the method can parse through string 401 in the respective direction in accordance with the selected rule in order to determine the at least one indicator 421, 422, 423 to 432.

For illustrative purposes and without any limitation, the method according to the third of the invention will now be explained for a second example of a selected rule, wherein the predetermined representative is a '0', the predetermined starting position is the last position in the string and the respective direction represents a direction extending downwardly in the string 410. FIG. 4*c* shows the determined at least one indicator 441, 442, 443 to 452 in accordance with this second example of a selected rule.

According to this second example of the third embodiment of method 200, a first indicator 441 of the at least one indicator 441 . . . 452 is determined, the first indicator 441 representing the distance between the respective starting position, i.e., the predetermined starting position, and the respective position of a next predetermined representative in string 401, i.e., the position of the next '0'. In this example, the predetermined starting position represents the last position in the string, i.e., position 27 associated with symbol $s_{07}$. With respect to this predetermined starting position and the respective direction, the next predetermined representative '0' is in position 27 (symbol $s_{27}$), since the starting position comprises the predetermined representative '0'. Accordingly, the first indicator 441 is determined to indicate distance 0 with respect to the predetermined starting position. Thus, the first indicator 441 may be considered as a representative of symbol $s_{27}$, wherein distance 0 indicates that the next predetermined representative '0' in string 441 is in a position shifted by this distance in the respective direction with respect to the respective starting position, i.e., with respect to first indicator 441, shifted by distance 0. For instance, as depicted in FIG. 4*c*, an indicator of the at least one indicator 441, 442 to 452 may represent the respective distance by means of an integer number d, wherein d≥0 holds. Accordingly, with respect to an indicator indicating a distance d, the string comprises d symbols of the alphabet's representative not being the predetermined representative, starting from the respective position associated with the indicator in the respective direction, and the string comprises the predetermined representative in a position shifted from the respective starting position by d positions in the respective direction.

With respect to FIG. 4*c*, the at least one indicator represents at least two indicators 441 . . . 452.

According to this second example of a rule for the third embodiment of method 200, a further indicator 422 of the at least two indicators 441 . . . 452 is determined, the further indicator 442 representing the distance between the respective starting position and the respective next position of the predetermined representative in string 410, i.e., the next position of the representative '0'. The respective starting position associated with this second indicator 442 represents a starting position based on the position of the predetermined representative associated with one preceding indicator of the at least two indicator 441 . . . 452. I.e., in this example, the preceding indicator may represent the first indicator 441 and thus, the respective starting position of further indicator 442 may be based on the next position of the predetermined representative of the first indicator 441, i.e., based on position 27 in this example. Since the respective direction extends downwardly in the string in this example, the respective starting position of the further indicator may represent the preceding position in the string with respect to the next position of the predetermined representative of the first indicator 441, i.e., the respective starting position of the further indicator may be position 26.

Starting at position 26 in string 401, the next position of predetermined representative '0' is determined to be position 26. Accordingly, the further indicator 442 is determined to indicate a distance 26. In this way, the method can parse through string 401 in the respective direction in accordance with the selected rule in order to determine the at least one indicator 441, 442, 443 to 452.

For instance, this method according to a third embodiment of the invention may be used for determining a representation of the string comprising at least one encoded representative as depicted in step 120 in FIG. 1*b* with respect to the first embodiment or the second embodiment of the invention. Thus, the further embodiments of the invention, which will be presented in the sequel, may also be used for determining a representation of the string comprising at least one encoded representative as depicted in step 120 in FIG. 1*b* with respect to the first embodiment of the invention. As an example, the input string obtained in step 210 in FIG. 2*a* with respect to the method according to a third embodiment of the invention may represent one group of the at least one group of representatives, wherein the above-mentioned encoding scheme explained with respect to the method according to the first and second embodiment of the invention may be realized by means of the method according to the third embodiment of the invention, wherein the string obtained in step 210 may represent one group of the at least one group of representatives used for encoding. For instance, each group of the at least one group of representatives may be encoded by means of the method according to a third embodiment of the invention, or, as another non-limiting example, each group except for the last group of the at least one group of representatives may be encoded by means of the method according to a third embodiment of the invention.

Furthermore, for instance, the first group may be associated with the six complementary representatives '1' at the beginning of the string, i.e., G1 may be considered as first group, wherein holds. The representatives in the original string between the first and last group may be associated with one or more groups. For instance, a second group G2 may comprise the representatives between the first group G1 and the last group G1, i.e., G2=[0 0 0 1 1 0 0 0 0 1 0 0 0 0 0 0 0] may hold.

The last group G1 of the original string is permutated to another position in the string. For instance, as exemplarily mentioned above, the last group may be permutated between the first group G1 and the subsequent group G2. Thus, the permutated string may be represented by S1-a=[G1 G1 G2].

Figure 2B:
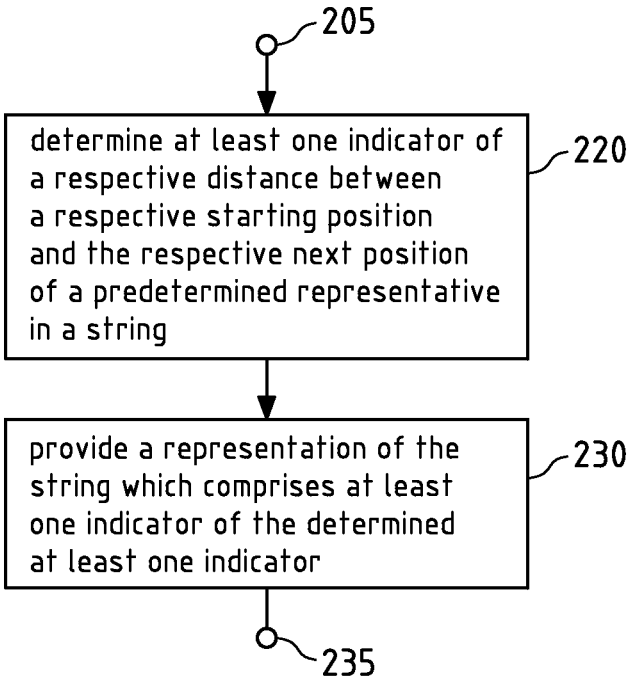
FIG. 2*b*: a flowchart of a method according to a fourth embodiment of the invention.

FIG. 2*b* shows a flowchart 250 of a method according to a fourth embodiment of the invention. This method according to the fourth embodiment of the invention comprises determining at least one indicator of a respective distance between a respective starting position and the respective next position of a predetermined representative in a string (step 220) in accordance with the method according to the third embodiment of the invention explained with respect to FIG. 2*a*.

Furthermore, this method comprises providing a representation of the string which comprises at least one indicator of the determined at least one indicator. For instance, this representation may comprise each of the at least one determined indicator or the representation may comprise as many of the determined at least one indicator as needed for a representation of the string. The representation may represent a vector or a string and the at least one indicator of the determined at least one indicator is arranged in this vector or a string in a predefined manner, e.g. in accordance with the order of determining the at least one indicator.

For instance, the representation may comprise the determined at least one indicator except for the last indicators indicating a distance of zero. E.g., with respect to the at least one indicator 421 . . . 432 depicted in FIG. 4*b*, the representation of the string may comprise indicators 421 to 430, i.e., the last indicators 431, 432 indicating a zero distance are omitted. Under assumption that the length of the string is known, the string may be reconstructed by means of this representation comprising indicators 421 to 430, wherein the remaining symbols in the string not being associated with these indicators 421 to 430 can be filled with the predetermined representative, since in accordance with distance zero of the omitted indicators 431 and 432 these remaining symbols must be the predetermined representative.

Furthermore, the representation of the string may comprise a representative being indicative of the selected rule. For instance, if the set of rules are exactly two rules, then one bit may be used for such a representative, but any other representative may also be used for indicating the rule. Accordingly, a decoder may identify the rule which has been used for determining the at least one indicator based on this representative. Based on this identified rule, the string can be reconstructed based on the representation of the string.

For instance, in case this fourth embodiment of the invention is used for determining a representation of the string of the first or second embodiment of the invention, as a non-limiting example the input string obtained in step 105 may be represented by above-mentioned string S1=[1 1 1 1 1 1 1 0 0 0 1 1 0 0 0 0 1 0 0 0 0 0 0 0 1 1 1 1], wherein, in accordance with a rule and this example, the permutated string may be represented by S1-a=[G1 G1 G2], wherein G1=[1 1 1 1 1 1], G1=[1 1 1 1] and holds G2=[0 0 0 1 1 0 0 0 0 1 0 0 0 0 0 0 0] may hold.

For instance, the group G1 may be used as input string in step 210 depicted in FIG. 2*a*, and, in accordance with the selected rule, a representation of the string which comprises at least one indicator of the determined at least one indicator can be provided based on the fourth embodiment depicted in FIG. 2*b* in accordance with steps 220 and 230. As an example, in case the first example of a selected rule is applied, the string representing group G1 may be encoded by indicator '6', because there is none of the predetermined representative '0' in this string and thus this indicator indicates the length between the starting position and the end of the string.

Then, group G1 may be used as input string in step 210 depicted in FIG. 2*a*, and, in accordance with the selected rule, a representation of the string which comprises at least one indicator of the determined at least one indicator can be provided based on the fourth embodiment depicted in FIG. 2*b* in accordance with steps 220 and 230. In case the first example of a selected rule is applied, the string representing group G1 may be encoded by indicator '4'. Then, group G2 may be used as input string in step 210, wherein this string may be encoded by indicators '0 0 0 2 0 0 0 0 1'. The last representatives in group G2 representing the predetermined representatives, i.e. the seven '0' at the end of group may not be encoded, and, in accordance with the first embodiment of the invention, the encoded representation of string obtained in step 105 does not comprise an encoded representative being associated with at least one of these predetermined representatives '0' positioned at the end of the permutated string. On basis of the representations of the groups obtained by the third or fourth method, the representation of the string may be obtained by inserting the indicators determined for each group in the representation. For this example, the representation of the string S1 may be [6 4 0 0 2 0 0 0 1].

Figure 5:
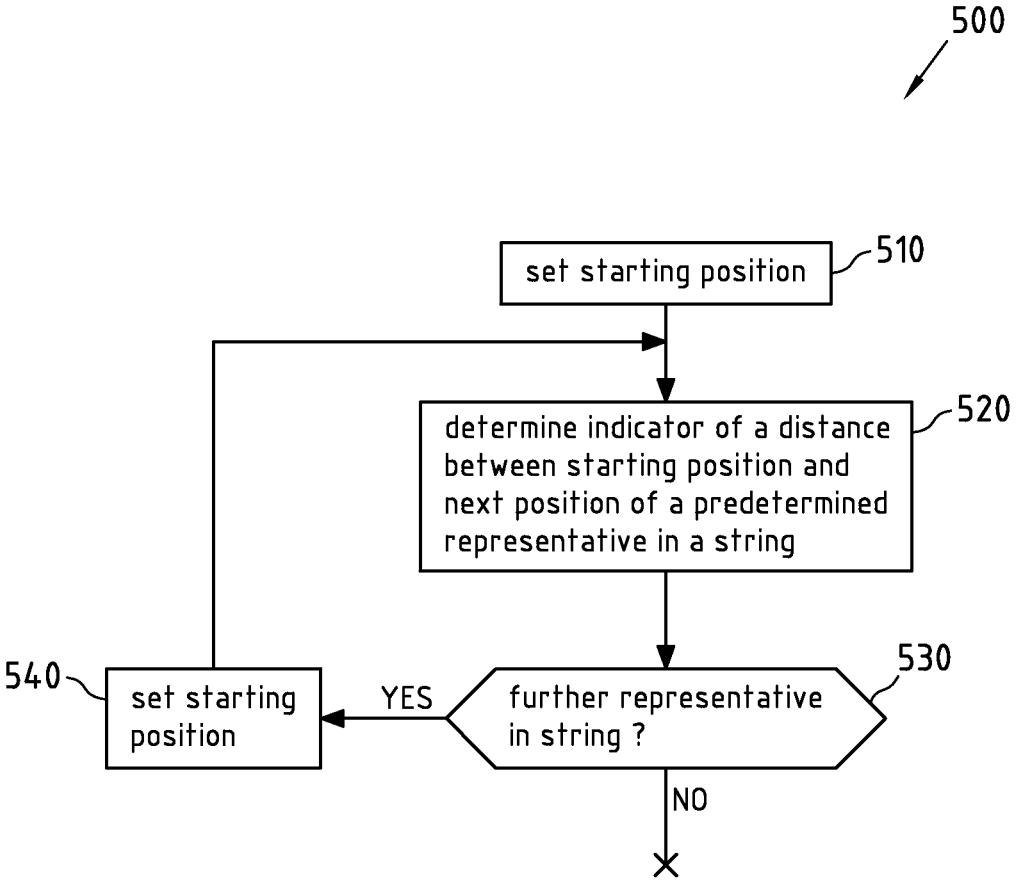
FIG. 5: a flowchart of a method according to a fifth embodiment of the invention.

FIG. 5 shows a flowchart 500 of a method according to a fifth embodiment of the invention. For instance, this method according to the fifth embodiment of the invention may be used to determine at least one indicator in step 220 in accordance with the third embodiment of the invention explained with respect to FIG. 2*a* or to determine at least one indicator in step 220 in accordance with the fourth embodiment of the invention explained with respect to FIG. 2*b*.

This method comprises setting the starting position to a starting position (step 510) based on a rule of the at least one predefined rule. For instance, a rule may define that the starting position represents the first position in the string, or a rule may define that the starting position represents the last position in the string, or a rule may define that the starting position is another predefined starting position in the string.

The method according to a fourth embodiment will now be exemplified with respect to the above mentioned first example of a rule, but any other well-suited rule may also be applied to this method.

In accordance with the first example of a rule, the method sets the starting position, denoted as sp, to the first position in the string in step 510. With respect to string 401 depicted in FIG. 4*a*, this first position is position 0 associated with the first symbol $s_0$, i.e., sp=0 is set in step 510.

Then an indicator of a distance between the starting position sp and a next position of the predetermined representative is determined in step 520 in the respective direction in the string. In accordance with the first example, the predetermined representative is a '0' and the respective direction extends upwardly. Step 520 may comprise determining the next position of the predetermined representative with respect to starting point sp in the upward direction, the next position being denoted as np. Starting at sp=0 in string 401, this next position np is determined to be position 5, i.e., np=5 holds. Then, distance d is determined by np-sp (or, in case of a rule with a respective direction extending downwardly, d=sp−np), i.e., in this example, distance d of the first indicator 421 is determined to be d=5−0=0. Accordingly, an indicator determined during step 520 may be considered as a representative of symbols $s_{sp}$ to $s_{np}$ in the string. With regard to the example string 401, the first indicator 421, which may be denoted as $i_0$, may be set to 5, as indicated in FIG. 4*b*. Furthermore, for instance, a loop counter k may be initialized during step 510, e.g. k=0, such that indicator $i_k$ is determined during step 520.

Then it is checked in step 530 whether there is a further representative in the string. A further representative may represent a representative in the string which is not associated with any of the indicators of the at least one indicator which have been determined so far by the loop depicted in FIG. 5. For instance, it may be checked whether the string comprises a representative, i.e., a symbol, which is not associated with any of the indicators $i_0$ to $i_k$. Or, for instance, it may be checked if the actual next position $np_k$ is less than last position in the string (or, in case of a rule with a respective direction extending downwardly, if the actual next position $np_k$ is larger than the first position in the string). Furthermore, as another example, it may be checked whether there are any further of the predetermined representative in the string.

In case said checking yields in a positive result, the method proceeds at step 540 by setting the starting position to a new value. For instance, in case said checking yields in a positive result, the loop counter k may be incremented.

This setting the starting position in step 540 may be performed in a manner that the string 401 is parsed in accordance with the selected rule. For instance, with respect to the first example of a rule, the starting position may be set to a position based on the next position $np_k$ associated with the last determined indicator $i_{k-1}$ of a distance, wherein the starting position $sp_k$ may represent the next position in the respective position in the string 401, i.e., $sp_k=np_{k-1}+1$ (or, in case of a rule with a respective direction extending downwardly, $sp_k=np_{k-1}-1$).

Then the method proceeds with determining an indicator of the at least one indicator of a distance between the new starting position, which has been set in step 540, and the next position of the predetermined representative in the string, as explained above with respect to step 520.

In this way the method may parse through the string 401 in accordance with the selected rule, e.g. until every representative in a string 401 is associated with one of the at least one indicator.

Figure 6A:
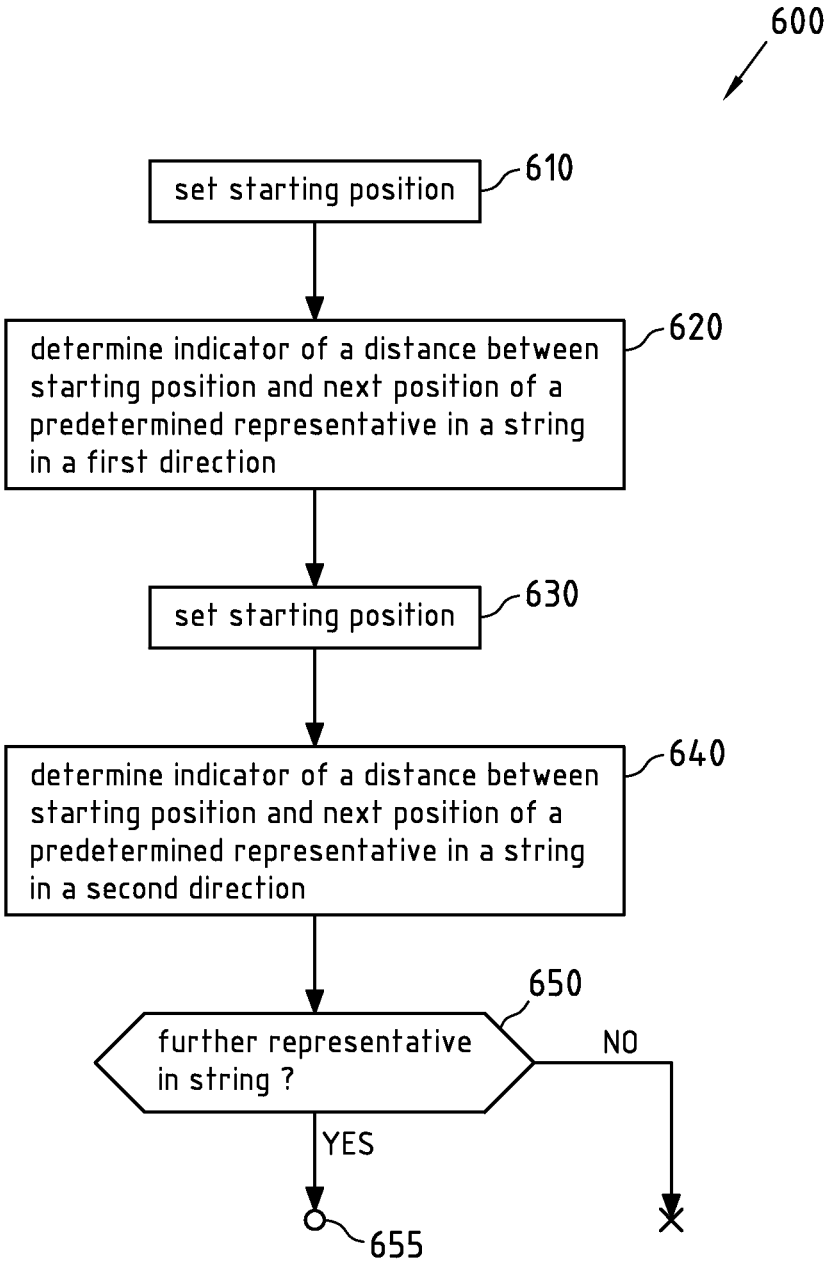
FIGS. 6*a* and 6*b*: a flowchart of a method according to a sixth embodiment of the invention.
Figure 6B:
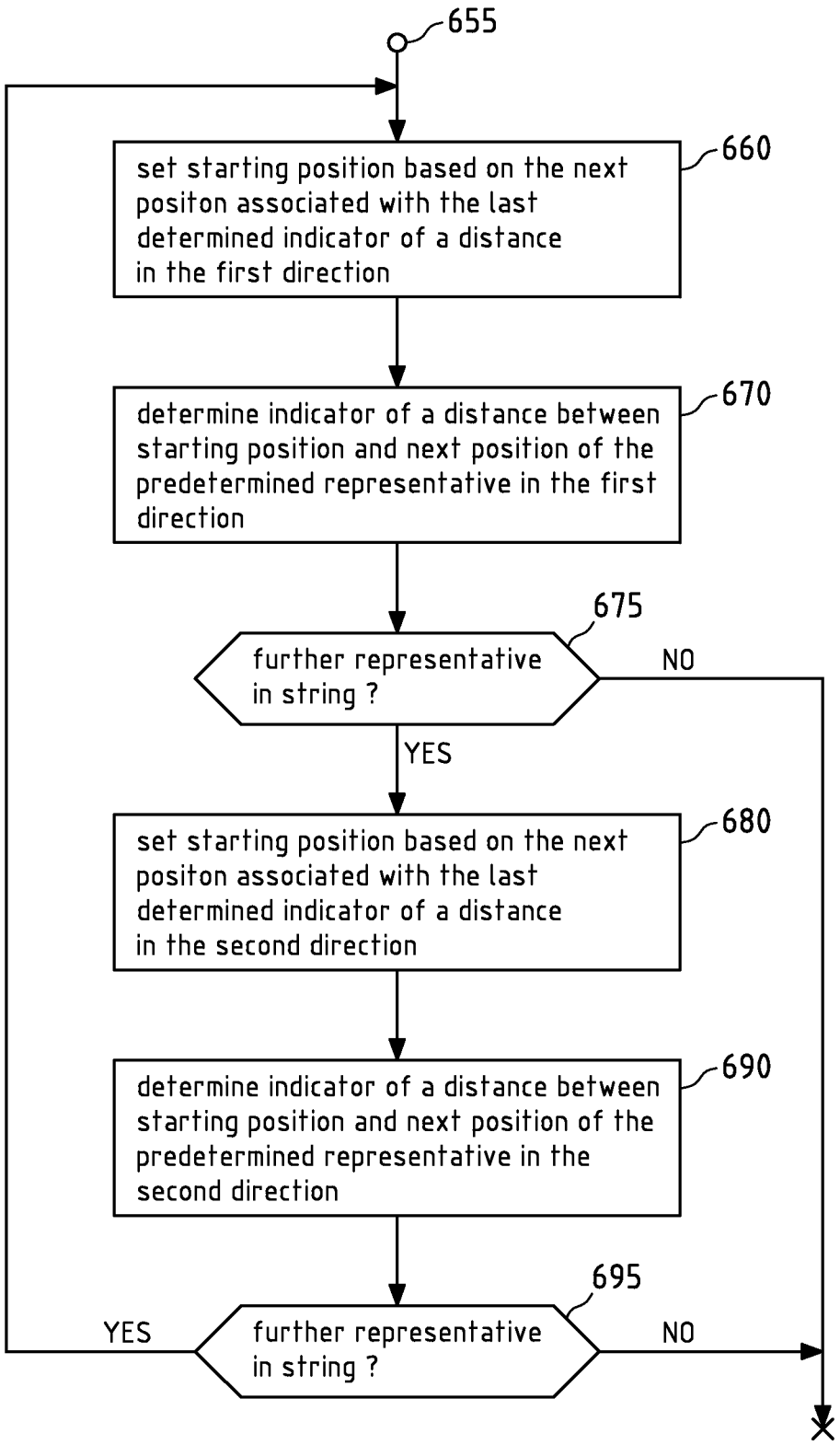

FIGS. 6*a* and 6*b* show a flowchart 600 of a method according to a sixth embodiment of the invention. For instance, this method according to the sixth embodiment of the invention may be used to determine at least one indicator in step 220 in accordance with the third embodiment of the invention explained with respect to FIG. 2*a*.

This method according to a sixth embodiment of the invention will be explained with respect to a third example of a rule of the set of rules. This third example of a rule will be denoted as selected rule with respect to this fifth embodiment of the invention. In accordance with this selected rule, a string will be processed in an alternating way starting either from the first position of the string or from the last position of the string. In the sequel, this fifth embodiment of the invention will be explained with respect to the string 401 depicted in FIG. 4*a* and with respect to the at least one indicator 461 to 473 depicted in FIG. 4*d*.

This method comprises setting the starting position (step 601) to a starting position based on the selected rule. For instance, the starting position may be set to the first position of a string, wherein this starting position may be denoted as first starting position.

Then, a first indicator 461 of a distance between this starting position and a next position of a predetermined representative in a string 401 in a first direction is determined. In case the selected rule specifies the starting position in step 610 to represent the first position in the string, the first direction represents a direction extending upwardly in the string. Otherwise, in case the selected rule specifies the starting position in step 610 to represent the last position in the string 401, the first direction represents a direction extending downwardly in the string 401. This determined indicator 461 may be associated with a counter index k=0, wherein the first starting position determined in step 610 may be denoted as $sp_k$ and the next position of the predetermined representative in the first direction may be denoted as $np_k$. Accordingly, the distance d of the determined indicator $i_0$ may be determined to be $np_0-sp_0$ (or, if the first direction extends downwardly to be $d=sp_0-np_0$).

Then, the starting position is set to another starting position in step 630, wherein this other starting position represents a second starting position being opposite to the first starting position in the string 401, i.e., in case the first starting position is the first position in the string 401, the second starting position set in step 630 represent that last position in the string 401 or vice versa, which depends on the selected rule.

In this example, the second starting position may be assumed to represent the last position in the string 401.

Then, a further indicator 462 of a distance between this starting position and a next position of a predetermined representative in a string 401 in a second direction is determined. In case the selected rule specifies the second starting position in step 620 to represent the second position in the string 401, the second direction represents a direction extending downwardly in the string. Otherwise, in case the selected rule specifies the second starting position in step 630 to represent the first position in the string 401, the second direction represents a direction extending upwardly in the string 401. In this example, the second direction may be assumed to represent a direction extending downwardly in the string 401.

This determined further indicator 462 may be associated with a counter index k=1, wherein the second starting position determined in step 630 may be denoted as $sp_1$ and the next position of the predetermined representative in the second direction may be denoted as $np_2$. Accordingly, the distance d of the determined further indicator $i_1$ may be determined to be $np_1-sp_1$ (or, if the second direction extends downwardly to be $d=sp_1-np_0$).

Then it is checked in step 650 whether there is a further representative in the string. A further representative may represent a representative in the string which is not associated with any of the indicators of the at least one indicator which have been determined so far by the method. For instance, it may be checked whether the string 401 comprises a representative, i.e., a symbol, which is not associated with any of the indicators $i_0$ to $i_k$, wherein k=1 holds for the checking whether there is a further representative in step 650. For instance, it may be checked if the actual next position $np_k$ (i.e., for k=1) is larger than the preceding next position $np_k$ plus one, i.e. there is a further representative if $np_k>(np_{k-1}+1)$ holds (or, in case of a rule with a first direction extending downwardly and the second direction extending upwardly, if the actual next position $np_k$ is less than the preceding next position $np_{k-1}$ minus 1, i.e, there is a further representative if $np_k<(np_{k-1}-1)$ holds). Furthermore, as another example, it may be checked whether there are any further of the predetermined representative in the string.

In case said checking yields in a positive result, the counter index k may be incremented (not depicted in FIG. 6*a*).

Furthermore, in case said checking yields in a positive result, the method proceeds with setting the starting position based on the next position associated with the last determined indicator of a distance in the first direction in step 660, i.e., the starting position $sp_k$ is set based on $np_{k-2}$. For instance, the starting position $sp_k$ may represent the next position in the first direction in the string 401 with respect to $np_{k-2}$, i.e., $sp_k=np_{k-2}+1$ in the present example where the first direction extends upwardly (in case the first direction extends downwardly, $sp_k=np_{k-2}-1$ may hold).

Then, a further indicator $i_k$ of a distance between the starting position $sp_k$ and the next position $np_k$ of the predetermined representative in the first direction is determined. For instance, this determining can be performed as explained above, e.g. as explained with respect to step 620.

Then it is checked in step 675 whether there is a further representative in the string. A further representative may represent a representative in a position in the string which is not associated with any of the indicators of the at least one indicator which have been determined so far by the method. For instance, it may be checked whether the string 401 comprises a representative, i.e., a symbol, which is not associated with any of the indicators $i_0$ to $i_k$. For instance, it may be checked if the actual next position $np_k$ is less than the preceding next position $np_{k-1}$ minus 1, i.e, there is a further representative if $np_k<(np_{k-1}-1)$ holds (or, in case of a rule with a first direction extending downwardly and the second direction extending upwardly, if the actual next position $np_k$ is larger than the preceding next position $np_{k-1}$ plus one, i.e. there is a further representative if $np_k>(np_{k-1}+1)$ holds).

In case said checking yields in a positive result, the counter index k may be incremented (not depicted in FIG. 6*b*).

Furthermore, in case said checking yields in a positive result, the method proceeds with setting the starting position based on the next position associated with the last determined indicator of a distance in the second direction in step 680, i.e., the starting position $sp_k$ is set based on $np_{k-2}$. For instance, the starting position $sp_k$ may represent the next position in the second direction in the string 401 with respect to $np_{k-2}$, i.e., $sp_k=np_{k-2}-1$ in the present example where the second direction extends upwardly (in case the second direction extends downwardly, $sp_k=np_{k-2}+1$ may hold).

Then, a further indicator $i_k$ of a distance between the starting position $sp_k$ and the next position $np_k$ of the predetermined representative in the second direction is determined. For instance, this determining can be performed as explained above, e.g. as explained with respect to step 640.

It is then checked if there is a further representative in the string 401 in step 695. This checking may be performed as explained with respect to step 650. In case said checking yields in a positive result, the counter index k may be incremented (not depicted in FIG. 6*b*). Furthermore, in case said checking yields in a positive result, the method proceeds with setting the starting position based on the next position associated with the last determined indicator of a distance in the first direction in step 660.

Accordingly, the method 600 depicted in FIGS. 6*a* and 6*b* allows to parse through the string 401 in an alternating way, starting from the first starting position in the first direction (steps 620 and 630), then proceeding from the second starting position in the second direction, wherein this second direction extends in the opposite direction compared to the first direction (steps 640 and 650), and then the method may proceed by alternatively changing the direction in order to parse the string from the outer ends of the string to the middle.

Figure 7:
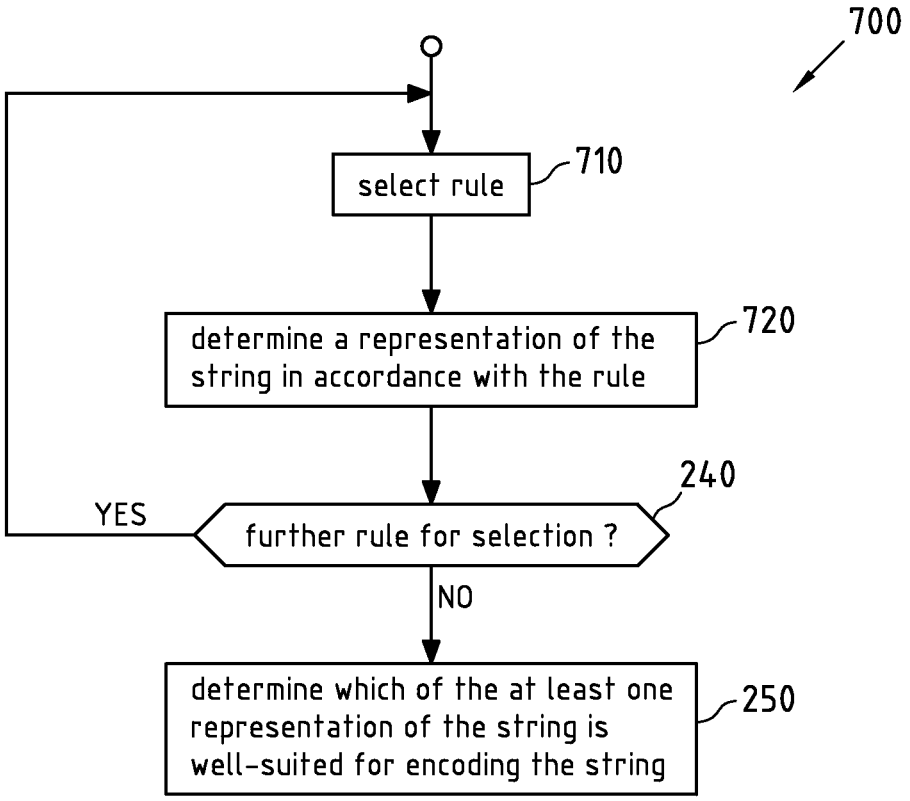
FIG. 7: a flowchart of a method according to a seventh embodiment of the invention.

FIG. 7 shows a flowchart 700 of a method according to a seventh embodiment of the invention. This method according to the seventh embodiment of the invention may be based on the fifth embodiment of the invention and/or on the first or second embodiment of the invention.

This method comprises selecting a rule of the set of rules in step 710. For instance, the set of rules may comprise the first example of a rule, and/or the second example of a rule, and/or the third example of a rule, and or at least one further example of a rule.

Then, in accordance with the selected rule, a representation of the string in accordance with the rule is determined in step 720. For instance, with respect to the first and second embodiment of the invention, this string may represent the string obtained in step 105, wherein the representation determined in step 720 may comprises ensuring that the string comprises at least one of a predetermined representative at the end of the string in accordance with step 110 and determining the representation of the string in accordance with step 120 depicted in FIG. 1*b*. For instance, in accordance with the selected rule a run-length encoding may be applied for the encoding scheme, or the encoding based on the third embodiment (or subsequent embodiments) of the invention may be applied, or another well-suited encoding scheme.

Furthermore, for instance, in accordance with another rule, the string may represent the string obtained in step 210 with respect to the third embodiment, wherein a representation of this string in accordance with the rule comprises at least one indicator of a respective distance between a respective starting position and the respective next position of a predetermined representative in a string which is determined in step 220. This determining may be performed in accordance with each of the above explained methods. For instance, if the selected rule is either the first example of a rule or the second example of the rule, the method according to the fifth embodiment depicted in FIG. 5 may be used for performing step 220, or, if the selected rule is the third example of a rule, the method according to the sixth embodiment depicted in FIGS. 6*a* and 6*b* may be used for performing step 220. In step 720, a representation of the string associated with the selected rule is provided. For instance, in case the encoding is based on the third embodiment (or subsequent embodiments) of the invention, this representation comprises at least indicator of the determined at least one indicator. This step 720 may be performed as explained with respect to step 230 in FIG. 2*b*. For instance, steps 220 and step 230' may be performed simultaneously.

As another example, in case the first or second embodiment of the invention is applied, step 720 may comprise steps 110 and 120 depicted in FIG. 1, and for instance, any of the above-mentioned features disclosed with respect to the first and second embodiment of the invention. Thus, the string determined in step 720 comprises the at least one encoded representative, wherein said representation does not comprise an encoded representative being associated with at least one of the at least one predetermined representative at the end of the string in accordance with step 120. This determining of the string comprises determining said at least one encoded representative based on an encoding scheme in accordance with the selected rule, wherein said encoding scheme is applied on the basis of at least one group of representatives, said at least one group being out of: at least two group of representatives of the string, and exactly one group of representatives. With regard to this groupwise encoding it is referred to the examples mentioned above in accordance with the first and second embodiment of the invention. For instance, the encoding scheme may represent a run-length encoding, or the encoding based on the third embodiment (or subsequent embodiments) of the invention may be applied, or any other well-suited encoding scheme.

Then it is checked whether there is a further rule for selection in step 240. If this checking yields a positive result, the method returns to step 710 in order to select this further rule and to provide a representation of the string associated with this selected rule.

If this checking yields a negative result, the method proceeds with determining which of at the at least one representation of the string is well-suited for encoding the string. For instance, well-suited may be the representation having the lowest data size, e.g., the less amount of bits.

This well-suited representation may be selected. For instance, this well-suited representation may comprise a representative which indicates the associated rule.

Figure 8A:
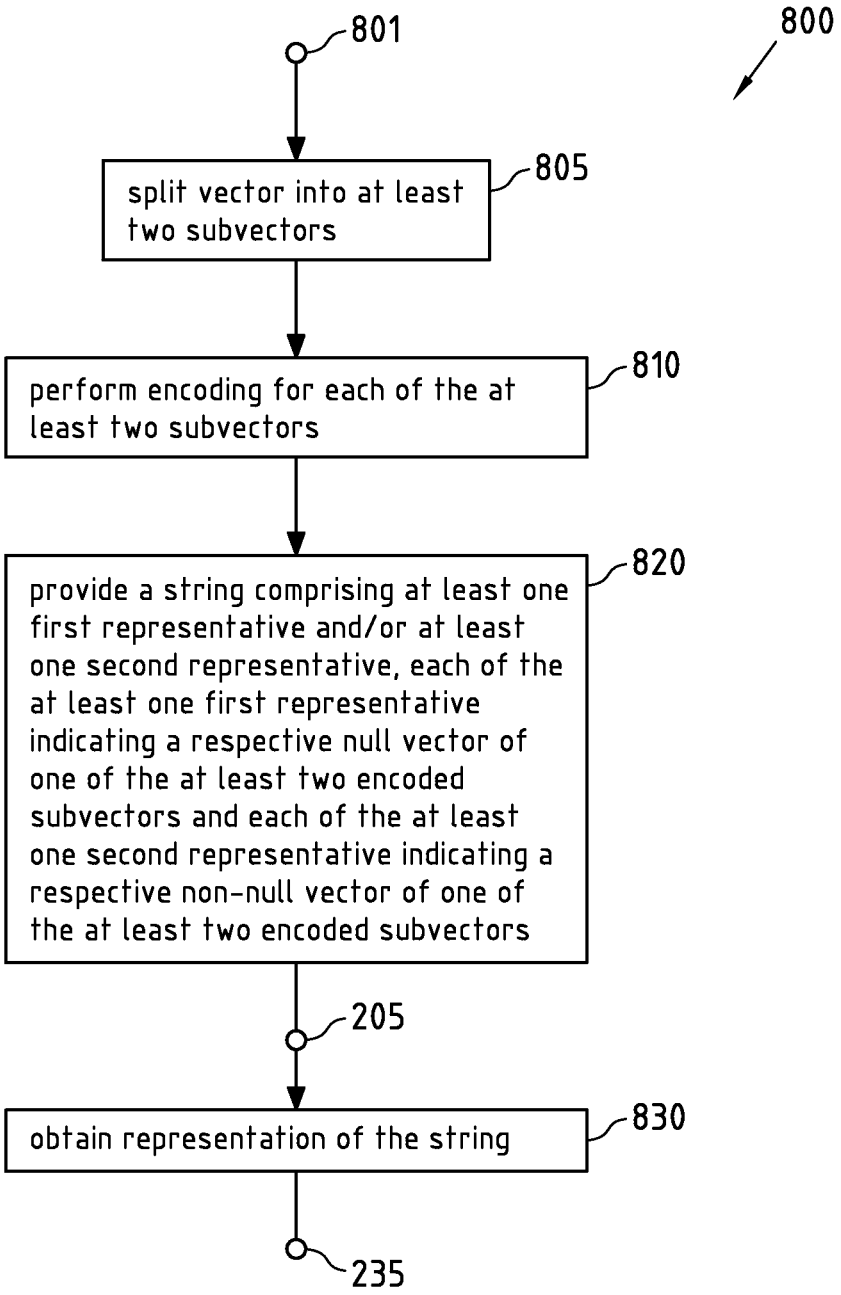
FIG. 8*a*: a flowchart of a method according to an eighth embodiment of the invention.

FIG. 8*a* shows a flowchart 800 of a method according to a eighth embodiment of the invention. This method according to the eighth embodiment of the invention may be based on the fifth embodiment and/or the first or second embodiment of the invention.

Method 800 comprises splitting a vector into at least two subvectors in step 805. The vector comprises a plurality of coefficients. Each of the at least one subvector comprises at least one coefficient.

This vector may represent any vector comprising data to be encoded. For instance, this may be audio data or video data or other data. For instance, incase of video data this vector may comprise coefficients from at least one transform coefficient block of an image to be encoded, e.g., the coefficients of significant transform coefficient blocks.

For instance, as a non-limiting example, this vector may represent a vector obtained during an Adaptive Multi-Rate (AMR)-Wideband (WB) encoding, wherein a Modified Discrete Cosine Transformation (MDTC) is performed on a difference signal and the transform coefficients are encoded. For instance, encoding of these transform coefficients for a bitstream may include encoding a vector comprising a plurality of coefficients with a predetermined amount of bits per bitstream. For instance, a vector may comprise 280 coefficients, wherein this vector is encoded with 160 bits per bitstream. As an example, this vector comprising 280 coefficients may be split into 10 dimensional subvectors resulting in 28 subvectors. Any other well-suited splitting of the vector into the at least two subvectors may also performed.

Then, an encoding is performed for each of the least two subvectors in step 810. The encoding of the subvectors may be performed by means of a plurality of codevectors, wherein each of the subvector is encoded with a codevector from the plurality of codevectors. For instance, the nearest codevector from the plurality of codevectors may be used for encoding a respective subvector. The plurality of codevectors may comprise one codevector representing a null codevector.

As a non-limiting example, in case of said AMR, a lattice quantization may be performed on each of the at least two subvectors in step 810. Thus, said encoding of each of the at least two codevectors may result in at least two quantized subvectors.

For instance, it is possible to define a lattice codebook as a union of leader classes, each of which is characterized by a leader vector.

Codebooks used within these speech and audio codecs may for instance be based on lattice structures, as described in reference "Multiple-scale leader-lattice VQ with application to LSF quantization" by A. Vasilache, B. Dumitrescu and I. Tabus, Signal Processing, 2002, vol. 82, pages 563-586, Elsevier, which is incorporated herein in its entirety by reference.

A leader vector is an n-dimensional vector (with n denoting an integer number), whose (positive) components are ordered (e.g. decreasingly). The leader class corresponding to the leader vector then consists of the leader vector and all vectors obtained through all the signed permutations of the leader vector (with some possible restrictions). It is also possible that one, some or all leader classes are respectively associated with one or more scales, and the lattice codebook is then formed as a union of scaled and/or unscaled leader classes. For instance, a D10+ lattice may be considered for quantization, but any other well-suited lattice quantization may also be considered.

A subvector may for instance be quantized by finding the nearest neighbor code vector in the codebook, i.e. the code vector that has the smallest distance with respect to the subvector. An identifier of this code vector (e.g. a codevector index assigned to this code vector) then may serve as a quantized representation of the subvector.

For instance, finding the nearest neighbor code vector in the codebook may comprise for each of the at least two subvectors identifying a leader vector of the plurality of leader vectors, the identified leader vector representing the nearest leader vector with respect to the respective subvector, and identifying the nearest code vector of the plurality of code vectors in the leader vector class associated with the identified leader vector. The identified leader vector for a respective subvector may be represented by a leader vector representation. This leader vector representation may for instance represent a leader vector index.

The codevector index within the leader vector class may for instance be obtained through an enumeration algorithm as described in reference WO 2009/100768 A1, which is incorporated herein by reference.

Then a string comprising at least one first representative and/or at least one second representative is provided in step 820, wherein each of the at least one first representative indicates a null vector of one of the at least two encoded subvectors and each of the at least one second representative indicates a non-null vector of one of the at least two encoded subvectors. For instance, this provided string may be assumed as input string in step 105 with respect to the first and second embodiment of the invention depicted in FIG. 1*b*, and/or it may be assumed as string used as input string in step 210 of the third embodiment depicted in FIG. 2*a*.

For instance, it may be determined which of the at least two encoded subvectors are represented by a null codevector, and for each of the encoded subvectors being represented by a null vector, the first representative is inserted in a respective position in the string, the respective position being associated with the respective quantized subvector. Thus, a first representative at position n in the string may indicate that the n-th subvector of the at least two subvectors is encoded by means of a null codevector. Furthermore, for instance, the remaining positions in the string may be filled with the second representative. Thus, a second representative at position n in the string may indicate that the n-th subvector of the at least two subvectors is encoded by means of a non-null codevector. For instance, this string may be considered as a representative indicating the positions of null codevectors and non-null codevectors used for encoding the at least two subvectors, wherein each of the at least two subvectors is either encoded by means of null codevector or a non-null codevector.

For instance, with respect to above mentioned example of a vector comprising 280 coefficients, which may be split into 28 subvectors in step 805, the string 401 depicted in FIG. 4*a* may represent an example of a string obtained in step 820, wherein the first representative is represented by "0" and the second representative is be represented by "1". Accordingly, string 401 has a length of 28 (equal to the amount of subvectors), wherein a "0" at position n indicates that the n-th subvector is encoded by means of a null codevector and a "1" at position n indicates that the n-th subvector is encoded by means of a non-null codevector.

After the string has been provided in step 820, the method proceeds with obtaining a representation of the string in step 830. As an example, this obtaining a representation may be based on the first or second embodiment of the invention, i.e., the representation of the string obtained in step 820 may be the representation of the string determined in step 120 in accordance with the first or second embodiment of the invention.

Furthermore, as another example, this representation of the string may be obtained by the method 250 according to a fourth embodiment of the invention depicted in FIG. 2*b*, as indicated by non-limiting reference signs 205 and 235 in FIG. 8*a*. Furthermore, as another example, the method 700 according to a seventh embodiment may be used for obtaining a representation of the string in step 830, wherein at least two representations are provided, each of the at least two representation being associated with a different rule, and wherein the well-suited representation of the string is determined based on these at least two representations.

For instance, the predetermined representative in a string may represent the first representative of the string provided in step 810, or it may represent the second representative of the string provided in step 820.

For instance, in case in step 830 the representation of the string ist obtained by the method 250 according to a fourth embodiment of the invention depicted in FIG. 2*b*, as indicated by non-limiting reference signs 205 and 235 in FIG. 8*a*, the representation of the string may be considered as encoded string based on at least one indicator of a respective distance between a respective starting position and the respective next position of the predetermined string obtained in step 220, as explained with respect to the method 200 according to a third embodiment and the subsequent methods according to the respective embodiments.

As another example, in case the first or second embodiment of the invention is applied in order to obtain the representation 830, step 830 may comprise steps 110 and 120 depicted in FIG. 1, and for instance, any of the above-mentioned features disclosed with respect to the first and second embodiment of the invention. Thus, the string determined in step 830 comprises the at least one encoded representative, wherein said representation does not comprise an encoded representative being associated with at least one of the at least one predetermined representative at the end of the string in accordance with step 120. This determining of the string may comprise determining said at least one encoded representative based on an encoding scheme in accordance with the selected rule, wherein said encoding scheme is applied on the basis of at least one group of representatives, said at least one group being out of: at least two group of representatives of the string, and exactly one group of representatives. With regard to this groupwise encoding it is referred to the examples mentioned above in accordance with the first and second embodiment of the invention. For instance, the encoding scheme may represent a run-length encoding, or the encoding based on the third embodiment (or subsequent embodiments) of the invention may be applied, or any other well-suited encoding scheme.

Figure 8B:
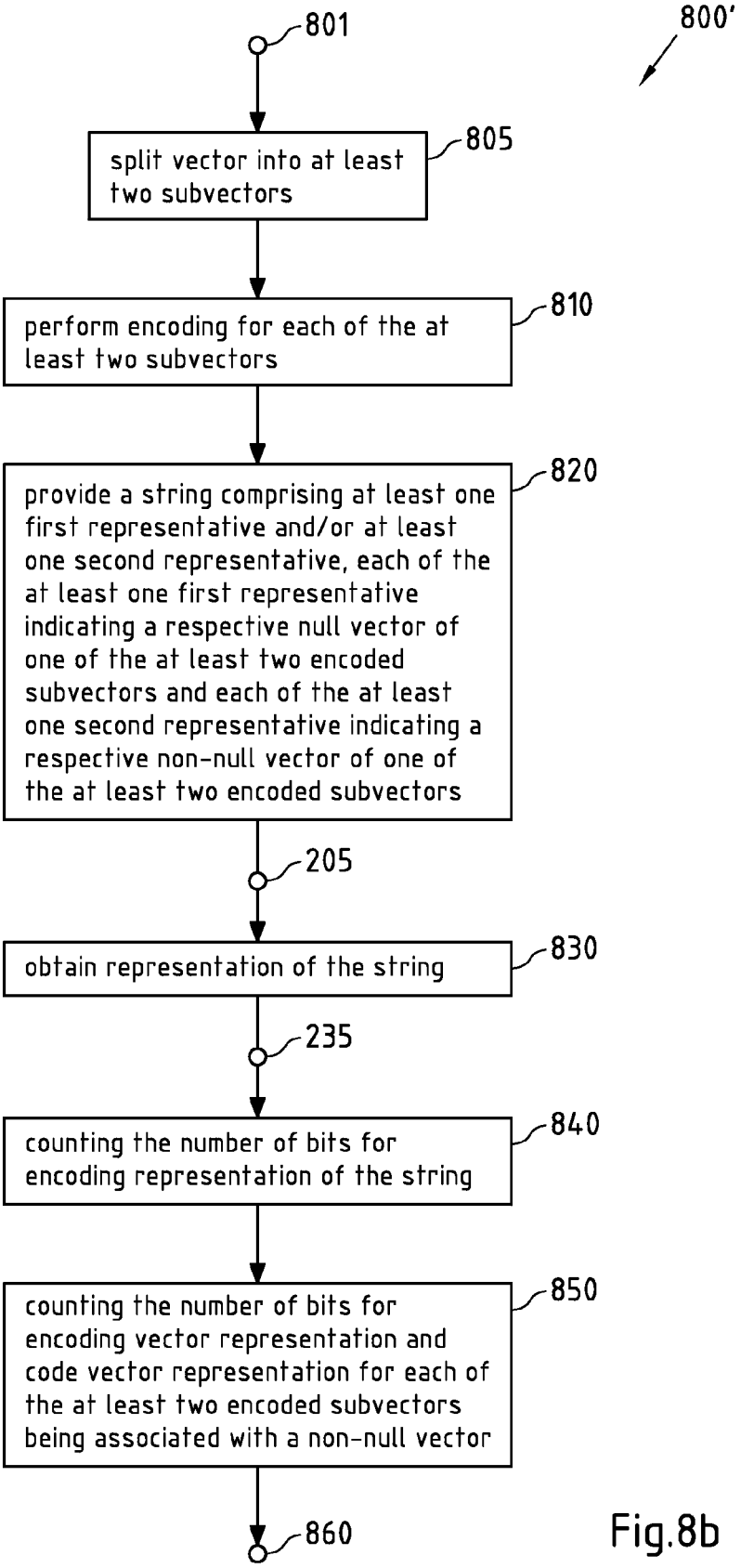
FIG. 8*b*: a flowchart of a method according to a ninth embodiment of the invention.

FIG. 8*b* shows a flowchart 800' of a method according to a ninth embodiment of the invention. This method according to the ninth embodiment of the invention is based on the eighth embodiment of the invention and further comprises counting the number of bits necessary for encoding.

The number of bits used for encoding the representation of the string, i.e., the number of bits to encode the significant positions of the non-null subvectors, may be counted in step 830. Thus, the encoded representation of the string may be represented by a binary encoded representation of the string. Then, in step 840, the number of bits used for encoding the leader vector representation and the code vector representation for each of the at least two quantized subvectors being associated with a non-null vector may be counted.

Furthermore, for instance, a Golomb Rice encoding may be performed for encoding the representation of the string, wherein an additional bit may be inserted in the encoded representation of the string, this additional bit being indicative of the selection of a Golomb Rice parameter used for encoding.

For instance, under the non-limiting assumption of the above-mentioned lattice quantization, the leader vector representation of each of the at least two quantized subvectors being associated with a non-null vector may be encoded using a Huffmann code, or a Golomb Rice code, wherein the Rice parameter may be dependent on the subvector index.

Accordingly, an encoded representation of the string and the encoded leader vector representation and encoded codevector representations may be considered as encoded representation of the input vector.

Then, a bitstream which comprises an encoded representation of the input vector may for instance be provided, wherein the encoded representation of the input vector is based on the representation of the string and on information for each of the at least two quantized subvectors being associated with a non-null vector.

For instance, under the non-limiting assumption of the above-mentioned lattice quantization, the encoded information for each of the at least two quantized subvectors may represent the encoded leader vector representation and the encoded code vector representation for quantizing the respective subvector.

Thus, for instance, the representation of the string and the information for each of the at least two encoded subvectors being associated with a non-null vector may be inserted in the bitstream. As another example, the encoded representation of the string and the information for each of the at least two encoded subvectors being associated with a non-null vector may be inserted in the bitstream.

As a non-limiting example, the representation of the string and the information for each of at least two quantized subvectors being associated with a non-null vector may be inserted in an alternating way in the bitstream. This insertion in an alternating way may for instance comprise inserting an indicator (or the encoded indicator) of the representation of the string in the bitstream, and, if this indicator is associated with at least one non-null vector of the at least two quantized subvectors, the information for each of the at least one encoded subvector associated with this at least one non-null vector is subsequently inserted in the bitstream. Then, the next indicator (or encoded indicator) of the representation of the string may be inserted in the bitstream, and, if this indicator is associated with at least one non-null vector of the at least two quantized subvectors, the information for each of the at least one encoded subvector associated with this at least one non-null vector is subsequently inserted in the bitstream. This information may for instance comprise the encoded leader vector representation and code vector representation for each of the at least one non-null vector of the at least two quantized subvectors associated with the respective indicator.

In this way, each indicator (or encoded indicator) of the representation of the string is inserted in the bitstream, and, for each of these indicator, in case the respective indicator is associated with at least one non-null vector of the at least two quantized subvectors, the information for each of the at least one quantized subvector associated with this at least one non-null vector is inserted subsequently to the respective indicator in the bitstream before the next indicator (or next encoded indicator) is inserted in the bitstream. If this filling has been finished and there are still bits left in the bitstream, these bits may be filled with representations for null subvectors. Furthermore, a representative of the selected rule may be inserted in the bitstream.

Thus, even in case the length of the encoded representation of the string (or the length of string) is not explicitly known and the representation of the string comprises the at least one indicator except for the last indicator(s) indicating a distance of zero, as described above, the string can be reconstructed.

For instance, under the assumption that the representation of the string has been determined based on the first or second embodiment of the invention, at a decoder, a received bitstream may be decoded in the following way: The encoded representatives of the representation of the string may be extracted from the bitstream. Furthermore, for instance, in case the representation comprises information indicating whether a permutation is performed, this information may be extracted from the bitstream and/or information indicating the rule of the set of rules may be extracted. In accordance with the rule and the corresponding decoding scheme, which may be applied on exactly one group of representatives in the string or on at least two groups of representatives in the string, the extracted encoded representations are encoded and may be inserted in a decoded representative of the string.

Since the length of the string is known to the decoder, the remaining positions in the decoded representative of the string are filled with the predetermined representative. Afterwards, it may be checked whether there has been performed a permutation on the string, e.g., based on the extracted information whether a permutation has been performed, and a re-permuation is performed on the representatives of the decoded representation of the string. Finally, the representatives in the decoded representation are used to reconstruct the null vectors and non-null vectors. For instance, it may be checked if the first representative in the decoded representation is associated with a non-null vector. If this checking yields in a negative result, a null vector may be inserted in a decoded vector at a position associated with the respective representative. If this checking yields a positive result, the respective encoded subvector is read from the bitstream, may be decoded and may be inserted in the decoded vector. In this way, for instance, for each of the representatives in the decoded representation it may be checked if the respective representative is associated with a non-null vector, and, if this checking yields in a negative result for a respective representative, a null vector may be inserted in a decoded vector at a position associated with the respective representative, and, if this checking yields a positive result, the respective encoded subvector is read from the bitstream, may be decoded and may be inserted in the decoded vector. As mentioned above, the encoding/decoding may be performed based on run-length encoding or on the method according to the third (or subsequent) embodiment of the invention or any other well-suited encoding/decoding.

For instance, under the assumption that the representation of the string has been determined based on the third embodiment of the invention (or one of the sequel embodiments of the invention), at a decoder, a received bitstream may be decoded in the following way: The first indicator may be extracted from the bitstream. This extraction may comprise decoding the first indicator in case it was inserted as an encoded indicator in the bitstream. Then it may be checked whether this indicator is associated with a non-null vector. If this checking yields in a negative result, the indicator is decoded to represent a null vector and this null vector may be inserted in a decoded vector at a position associated with the respective indicator and the respective rule (which may have been detected based on the received bitstream). If this checking yields in a positive result, i.e., if the respective indicator indicates a distance d larger than zero, the next d information of the d encoded subvectors is read from the bitstream and the respective d subvectors may be decoded and may be inserted in the decoded vector. The next subcodevector or codevector corresponding to the next subvector is decoded to represent a null vector, as indicated by the respective indicator, wherein this null vector may be inserted in the decoded vector subsequently after the d encoded subvectors. Then, it may be proceeded with the next indicator in the received bitstream.

Accordingly, the vector may be reconstructed even in case that the representation of the string, which has been used for inserting in the bitstream at the encoder, may comprise the at least one indicator except for the last indicators indicating a distance of zero. In this case, for instance, under the assumption that number of subvectors are known at the decoder, after the last indicator has been read from the bitstream and, if this last indicator indicates a distance larger than zero, the associated information of the d encoded subvectors is read from the bitstream, the rest of subvectors, which are not associated with the indicators in the received bitstream, must necessarily represent null vectors which may be inserted in the decoded vector.

As a non-limiting example, a further example of a string may be the following string: [1 1 1 0 0 1 0 0 0 0]

In accordance with the first example of a rule, the at least one indicator may comprise the following 10 indicators: 3 0 1 0 0 0

The representation of the string may comprise the at least one indicator except for the last indicators indicating a zero distance. Thus, the representation of the string may be: 3 0 1

Accordingly, if said alternating bitstream insertion is applied, value 3 is inserted in the bitstream (or an encoded representation of value 3) and the encoded leader index encoded leader vector representation and code vector representation for each of the three quantized subvectors (represented by non-null vectors) associated with this indicator "3" are inserted in the bitstream. Then, value 0 is inserted in the bitstream (or an encoded representation of value 0). Since this indicator "0" is not associated with a non-null vector, it is proceeded with the next indicator of the representation, i.e., value 1 is inserted in the bitstream (or an encoded representation of value 1) and the encoded leader vector representation and code vector representation of the one respective quantized subvector (represented by a non-null vector) is inserted in the bitstream.

At the decoder, first the indicator, i.e., value 3, may be reconstructed and the symbols of the string being associated with this indicator "3" may be encoded, i.e., the symbols "1 1 1 0" of the string may be decoded. In accordance with the detected distance d=3 of this indicator, the encoded data of the d=3 subvectors is read from the bitstream, wherein this encoded date comprises the encoded leader index representation and the encoded codevector representation of the d=3 subvectors of the quantized subvectors associated with this indicator "3". Accordingly, these 3 subvectors can be decoded. The subsequent subvector is decoded as null vector. Then the next indicator, i.e., value 0, may be reconstructed from the bitstream, the decoded string may be updated by one more '0', and the 5th subvector is decoded as null vector. Then the next indicator, i.e., value 1, may be reconstructed from the bitstream, the encoded data of the one (d=1) subvector is read from the bitstream, wherein this encoded date comprises the encoded leader index representation and the encoded codevector representation of the subvectors of the quantized subvectors associated with this indicator "1". Accordingly, this subvector can be decoded and represents the 6th subvector. The subsequent subvector, i.e., the 7th subvector is decoded as null vector. Since the bitstream comprises information on no further indicators, in particular no further information on further indicators indicating a distance larger than zero, it may now be checked if the number of decoded subvectors is less than the number of total subvectors. If this checking yields in a positive result, the remaining subvectors are decoded as null-vector. Otherwise, decoding of the subvectors is complete.

Figure 9:
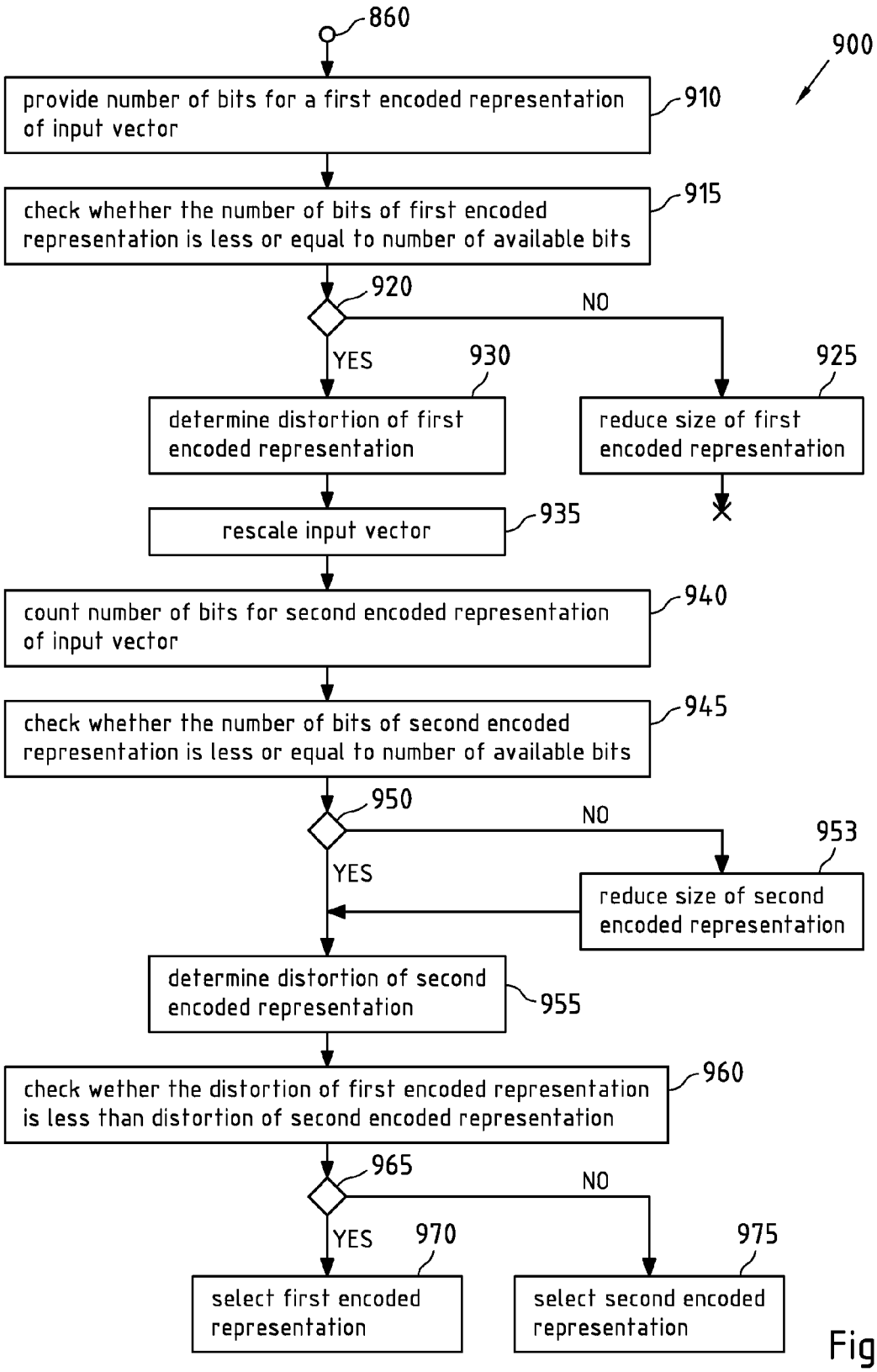
FIG. 9: a flowchart of a method according to an tenth embodiment of the invention.

FIG. 9 depicts a flowchart of a method 900 according to an tenth embodiment of the invention.

This method 900 may for instance be performed subsequent to the method 800' according to a ninth embodiment of the invention, as indicated by reference 860 in FIG. 9, wherein the number of bits for a first encoded representation of the input vector may be the sum of bits obtained in steps 840 and 850. Thus, this number of bits for a first encoded representation may represent the number of bits to encode the representation of the string and the bits for leader vectors and codevector indexes for the non-null subvectors may be counted, wherein it may be assumed that encoding of the representation of the string (and thus the positions of non-null codevectors) requires at least this number of bits.

The method 900 comprises checking whether the number of bits for this first encoded representation of the input vector is less than or equal to a number of available bits in step 915. This number of available bits may represent the number of bits of a bitstream, wherein this bitstream may represent a bitstream configured for storing or transmitting the encoded representation of the input vector. The number of bits in the bitstream may be fixed. For instance, the bitstream may comprise 160 bits, as mentioned above, but the bitstream may comprise any predefined number of bits.

If this checking yields a negative result, the method 900 may proceed with reducing the size of the first encoded representation of the input vector in step 925. This reduction of size of the first encoded representation of the input vector may be achieved by quantizing at least one of the at least two subvectors using leader vectors that use less number of bits. The number of bits considered to be used when encoding with a given leader vector is the sum between the bits used to encode the leader vector representative and the number of bits to encode the codevector representation from the given leader vector class. Thus, at least one of the at least two subvectors may be quantized using another leader vector and another codevector, wherein this codevector is determined from the codevectors of the leader vector class of the other leader vector in order to reduce the number of bits for encoding the at least one of the at least two subvectors.

For instance, the decision which at least one of the at least two subvectors may be quantized by another leader vector (and another codevector) may be performed based on a gradient approach. For instance, the gradient approach described in reference WO 2007/046027 A1, which is incorporated herein by reference, may be applied for deciding which at least one of the at least two subvectors may be quantized by an other leader vector (and another codevector).

Then, after step 925 is performed, the size-reduced first encoded representation may then for instance be determined and inserted in the bitstream. Furthermore, a distortion of this first encoded representation may be determined (not depicted in FIG. 9), which may be performed in accordance with step 930 in method 900, which will be explained in the sequel. Or, as another alternative, the method may proceed with 910, wherein the new number of bits for the first encoded representation is provide by means of counting the number of bits as mentioned above.

If this checking performed in step 920 yields a positive result, the encoded representation of the input vector may for instance be determined and inserted in the bitstream (not depicted in FIG. 9). A distortion of the first encoded representation may be determined in step 930. This distortion of the first encoded representation may represent a value being a representative of the distortion between the encoded first representation of the input vector and the input vector. The distortion between any vectors may for instance be computed according to a distance metric, as for instance a Minkowski metric, such as an Euclidean metric, a Manhattan metric or a Chebychev metric, to name but a few non-limiting examples. For instance, if the number of bits of the encoded representation of the input vector is less than then number of bits of the bitstream, the remaining bits in the bitstream may be filled one ore more codewords corresponding to null vectors. For instance, dependent on the encoding scheme, a codeword corresponding to a null vector may be represented by one zero, e.g. in case of the encoding in accordance with third or subsequent embodiment of the invention. For instance, in case the encoding scheme is based on run-length encoding, the bitstream may be filled with codewords corresponding to null vectors.

Afterwards, the method 900 may proceed with rescaling the input vector. This rescaling may be performed in a manner that the energy of the rescaled input vector is larger the energy of the input vector before rescaling. Then, the number of bits for a second encoded representation of the input vector, i.e., based on the rescaled input vector, is counted in step 940. For instance, this number of bits of the second representation of the input vector may be obtained by the method 800' depicted in FIG. 8*b*, i.e., step 940 may comprise the steps between reference 810 and 860 depicted in FIG. 8*b*. Furthermore, for instance, steps 820 and 830 may be omitted in method 800', i.e., the same subvectors of the non-rescaled input vector which have been encoded by null vectors may be quantized by means of null vectors with respect to the rescaled input vector, wherein the remaining subvectors may be requantized during step 810.

Then, method 900 may proceed with checking whether the number of bits of this second encoded representation of the input vector is less than or equal to a number of available bits in step 945, which may be performed similarly to step 915.

If this checking yields a negative result, the method 900 may proceed with reducing the size of the second encoded representation of the input vector in step 953. This reduction of size of the second encoded representation of the input vector may be performed similarly to the reduction of the size of the first encoded representation of the input vector in step 925.

Then, the distortion of the second encoded representation is determined in step 955, which may be performed similarly to step 930. If the checking performed in step 950 yields in a positive result, the method 900 does not reduces the size of the second encoded representation and may directly proceed with determining the distortion of the second encoded representation. Otherwise, the distortion of the size-reduced second encoded representation is determined in step 955.

Afterwards, method 900 comprises with checking whether the distortion of the first encoded representation is less than the distortion of the second encoded representation in step 960.

If this checking yields a positive result, the first encoded representation may be selected for insertion in the bitstream (step 970), and if this checking yields a negative result, the second encoded representation may be selected for insertion in the bitstream (step 975). This selection may comprise determining the respective encoded representation, inserting the encoded representation in the bitstream and, if the are remaining bits in the bitstream not used by the encoded representation, setting these remaining bit(s) to zero.

As used in this application, the term 'circuitry' refers to all of the following:

(a) hardware-only circuit implementations (such as implementations in only analog and/or digital circuitry) and (b) combinations of circuits and software (and/or firmware), such as (as applicable):

(i) to a combination of processor(s) or (ii) to portions of processor (s)/software (including digital signal processor(s)), software, and memory(ies) that work together to cause an apparatus, such as a mobile phone or a positioning device, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a positioning device.

With respect to the aspects of the invention and their embodiments described in this application, it is understood that a disclosure of any action or step shall be understood as a disclosure of a corresponding (functional) configuration of a corresponding apparatus (for instance a configuration of the computer program code and/or the processor and/or some other means of the corresponding apparatus), of a corresponding computer program code defined to cause such an action or step when executed and/or of a corresponding (functional) configuration of a system (or parts thereof).

The aspects of the invention and their embodiments presented in this application and also their single features shall also be understood to be disclosed in all possible combinations with each other. It should also be understood that the sequence of method steps in the flowcharts presented above is not mandatory, also alternative sequences may be possible.

The invention has been described above by non-limiting examples. In particular, it should be noted that there are alternative ways and variations which are obvious to a skilled person in the art and can be implemented without deviating from the scope and spirit of the appended claims.

The invention claimed is:

1. A method performed by an apparatus, said method comprising:

causing encoding of data to be stored or transmitted, wherein the data is encoded by:

applying, by executing circuitry in the apparatus, a function on a string in accordance with a rule of a set of rules, the string comprising first and second representatives, wherein the function ensures that the string comprises at least one of a predetermined representative at an end of the string after the function has been applied; and determining, by executing circuitry in the apparatus, a representation of the string, wherein said representation comprises at least one encoded representative, each of said at least one encoded representative being associated with at least one representative of the string, wherein said representation does not comprise an encoded representative being associated with at least one of the at least one predetermined representative at the end of the string.

2. The method according to claim 1, wherein said predetermined representative is one of the first and second representative and wherein a complementary representative is the other of the first and second representative, and where said function comprises:

classifying the string into at least two groups of representatives, each of said at least two groups comprising no or at least one representative of the string, wherein a last group of the at least two groups is associated with at least one complementary representative at the end of the string, if possible; and permutating at least the last group to another position in the string.

3. The method according to claim 1, wherein said function comprises checking if there is at least one of the predetermined representative at the end of the string, and, if this checking yields a negative result, permutating representatives of the string.

4. The method according to claim 3, wherein said permutating is performed based on at least one of:

permutating at least two groups of representatives in the string; and permutating single representatives in the string.

5. The method according to claim 4, wherein said predetermined representative is one of the first and second representative and wherein a complementary representative is the other of the first and second representative, and wherein said permutating based on permutating at least two groups of representatives in the string comprises:

classifying the string into at least two groups of representatives, wherein a last group of the at least two groups comprises the at least one complementary representative at the end of the string; and permutating the last group to another position in the string.

6. The method according to claim 1, wherein said determining the representation of a string comprises determining said at least one encoded representative based on an encoding scheme in accordance with the rule, wherein said encoding scheme is applied on the basis of at least one group of representatives, said at least one group being out of:

at least two groups of representatives of the string; and exactly one group of representatives of the string.

7. The method according to claim 6, wherein in accordance with one rule of the set of rules said determining at least one representative comprises for at least one group of the at least one group:

determining at least one indicator of a respective distance between a respective starting position and a respective next position of the predetermined representative in the group in a respective direction in accordance with the rule, wherein said at least one indicative represents at least one encoded representative associated with the group, wherein the respective starting position associated with a first indicator of the at least one indicator is a predetermined starting position based on the rule, and, in case the at least one indicator represents at least two indicators, the respective starting position associated with a further indicator of the at least two indicators is based on one of:

a further predetermined starting position based on the rule; and the respective next position of a predetermined representative associated with one preceding indicator.

8. The method according to claim 7, wherein the determining at least one indicator comprises:

setting the respective starting position to the predetermined starting point based on the rule;

determining an indicator of a distance between the respective starting position and the next position of the predetermined representative in the group in the predetermined direction in accordance with the rule, the first indicator of the at least one indicator being this indicator;

checking if there is a further representative in the group, and, if this checking yields a positive result:

updating the respective starting position; and determining an indicator of a distance between the updated respective starting position and the next position of the predetermined representative in the group in a respective direction in accordance with the rule, and proceeding with checking if there is a further representative in the group, wherein the respective direction is one of the predetermined direction and a further predetermined direction.

9. The method according to claim 1, comprising:

splitting a vector into at least two subvectors, performing an encoding for each of the at least two subvectors; and providing the string, wherein the string comprises at least one of the first representative and at least one of the second representative, each of the at least one first representative indicating a null vector of a respective one of the at least two encoded subvectors and each of the at least one second representative indicating a non-null vector of a respective one of the at least two encoded subvectors.

10. An apparatus, comprising at least one processor; and at least one memory including computer program code, said at least one memory and said computer program code configured to, with said at least one processor, cause said apparatus at least to:

cause encoding of data to be stored or transmitted, wherein the data is encoded by causing the apparatus to:

apply a function by the processor on a string stored in said memory in accordance with a rule of a set of rules, the string comprising first and second representatives, wherein the function ensures that the string comprises at least one of a predetermined representative at an end of the string after the function has been applied;

provide, by the processor, a representation of the string, wherein said representation comprises at least one encoded representative stored in said memory, each of said at least one encoded representative being associated with at least one representative of the string, wherein said representation does not comprise an encoded representative being associated with at least one of the at least one predetermined representative at the end of the string.

11. The apparatus according to claim 10, wherein said predetermined representative is one of the first and second representative and wherein a complementary representative is the other of the first and second representative, and where said function causes the apparatus to:

classify the string into at least two groups of representatives, each of said at least two groups comprising no or at least one representative of the string, wherein a last group of the at least two groups is associated with at least one complementary representative at the end of the string, if possible; and permutate the last group to another position in the string.

12. The apparatus according to claim 10, wherein said function comprises causes the said apparatus to check if there is at least one of the predetermined representative at the end of the string, and, if this check yields a negative result, permutate representatives of the string.

13. The apparatus according to claim 12, wherein said permutate is performed based on at least one of:

permutate at least two groups of representatives in the string; and permutate single representatives in the string.

14. The apparatus according to claim 13, wherein said predetermined representative is one of the first and second representative and wherein a complementary representative is the other of the first and second representative, and wherein said permutate based on permutate at least two groups of representatives in the string further causes the apparatus to:

classify the string into at least two groups of representatives, wherein a last group of the at least two groups comprises the at least one complementary representative at the end of the string; and permutate at least the last group to another position in the string.

15. The apparatus according to claim 10, wherein said apparatus caused to provide the representation of a string comprises determining said at least one encoded representative based on an encoding scheme in accordance with the rule, wherein said encoding scheme is applied on the basis of at least one group of representatives, said at least one group being one out of:

at least two groups of representatives of the string; and exactly one group of representatives of the string.

16. The apparatus according to claim 15, wherein in accordance with one rule of the set of rules said apparatus caused to determine at least one representative further causes the apparatus to for at least one group of the at least one group:

determine at least one indicator of a respective distance between a respective starting position and a respective next position of the predetermined representative in the group in a respective direction in accordance with the rule, wherein said at least one indicative represents at least one encoded representative associated with the group, wherein the respective starting position associated with a first indicator of the at least one indicator is a predetermined starting position based on the rule, and, in case the at least one indicator represents at least two indicators, the respective starting position associated with a further indicator of the at least two indicators is based on one of:

a further predetermined starting position based on the rule; and the respective next position of a predetermined representative associated with one preceding indicator.

17. The apparatus according to claim 16, wherein the apparatus caused to determine at least one indicator is further caused to:

set the respective starting position to the predetermined starting point based on the rule;

determining an indicator of a distance between the respective starting position and the next position of the predetermined representative in the group in the predetermined direction in accordance with the rule, the first indicator of the at least one indicator being this indicator;

check if there is a further representative in the group, and, if this checking yields a positive result:

updating the respective starting position; and determine an indicator of a distance between the updated respective starting position and the next position of the predetermined representative in the group in a respective direction in accordance with the rule, and proceeding with checking if there is a further representative in the group, wherein the respective direction is one of the predetermined direction and a further predetermined direction.

18. The apparatus according to claim 10, wherein said at least one memory and said computer program code is configured to, with said at least one processor, to cause said apparatus further to:

split a vector into at least two subvectors;

perform an encoding for each of the at least two subvectors;

provide the string, wherein the string comprises at least one of the first representative and at least one of the second representative, each of the at least one first representative indicating a null vector of a respective one of the at least two encoded subvectors and each of the at least one second representative indicating a non-null vector of a respective one of the at least two encoded subvectors; and obtain a representation of the string based on at least one determined indicator associated with a rule of the set of rules.

* * * * *